US011020846B2

(12) United States Patent
Kawano et al.

(10) Patent No.: US 11,020,846 B2
(45) Date of Patent: Jun. 1, 2021

(54) WORK TOOL

(71) Applicant: Koki Holdings Co., Ltd., Tokyo (JP)

(72) Inventors: Yoshikazu Kawano, Hitachinaka (JP); Tomoaki Sudo, Hitachinaka (JP); Kenichi Takaada, Hitachinaka (JP); Shinichi Sakuma, Hitachinaka (JP)

(73) Assignee: Koki Holdings Co., Ltd., Tokyo (JP)

( * ) Notice: Subject to any disclaimer, the term of this patent is extended or adjusted under 35 U.S.C. 154(b) by 225 days.

(21) Appl. No.: 16/079,874

(22) PCT Filed: Jan. 27, 2017

(86) PCT No.: PCT/JP2017/002951

§ 371 (c)(1),
(2) Date: Aug. 24, 2018

(87) PCT Pub. No.: WO2017/145643

PCT Pub. Date: Aug. 31, 2017

(65) Prior Publication Data

US 2019/0070721 A1 Mar. 7, 2019

(30) Foreign Application Priority Data

Feb. 26, 2016 (JP) ..... JP2016-036430

(51) Int. Cl.
*B25F 5/02* (2006.01)
*B25D 16/00* (2006.01)
(Continued)

(52) U.S. Cl.
CPC ..... *B25F 5/02* (2013.01); *B25D 16/00* (2013.01); *B25D 16/006* (2013.01); *B25D 17/20* (2013.01);
(Continued)

(58) Field of Classification Search
CPC ..... B25F 5/02; B25D 2217/0057; B25D 2217/0069; B25D 2250/221; B25D 17/20;
(Continued)

(56) References Cited

U.S. PATENT DOCUMENTS 6,502,949 B1 * 1/2003 Horiyama ..... B23Q 11/0046 173/217
2002/0129949 A1 * 9/2002 Bongers-Ambrosius ..... B23Q 1/0009 173/217
(Continued)

FOREIGN PATENT DOCUMENTS

CN 101451424 A 6/2009
CN 102189531 A 9/2011
(Continued)

OTHER PUBLICATIONS

European Patent Office Extended Search for EP17756085.1 dated Sep. 26, 2019, 19 pages.
(Continued)

*Primary Examiner* — Valentin Neacsu
(74) *Attorney, Agent, or Firm* — Kilpatrick Townsend & Stockton LLP

(57) ABSTRACT

Provided is a work tool that can work suitably in cooperation with an attachment device connected to a main body of the work tool to enhance work efficiency. The work tool includes a main body 2, and a control circuit 71 configured to provide control over the main body 2. The main body 2 includes a motor 3, an end-bit mount portion 10 and an end bit 14 as a work part configured to be driven by the motor 3 to perform a work. A dust collector 100 is connectable to the main body 2 to assist the work. The control circuit 71 is configured to detect whether the dust collector 100 is connected to the main body 2 and change the control over
(Continued)

the main body 2 based on whether the connection is established or not.

19 Claims, 12 Drawing Sheets

(51) Int. Cl.
*B25D 17/20* (2006.01)
*B25F 5/00* (2006.01)
*B25B 23/18* (2006.01)

(52) U.S. Cl.
CPC ..... *B25F 5/00* (2013.01); *B25B 23/18* (2013.01); *B25D 2217/0065* (2013.01)

(58) Field of Classification Search
CPC ..... Y10T 408/453; Y10T 408/455; Y10T 408/44; Y10T 408/45; Y10T 408/564
USPC ..... 173/2, 198, 3, 75, 197, 77; 408/58
See application file for complete search history.

(56) References Cited

U.S. PATENT DOCUMENTS

2002/0134811 A1* 9/2002 Napier ..... B24B 23/04 227/131
2004/0231871 A1* 11/2004 Arich ..... B23Q 1/0009 173/217
2004/0251041 A1* 12/2004 Grossman ..... B25F 5/003 173/217
2005/0089380 A1* 4/2005 Stoerig ..... B23Q 11/0046 408/67
2011/0008118 A1* 1/2011 Yoshikane ..... B23Q 11/0046 408/67
2011/0226499 A1* 9/2011 Kakiuchi ..... B23Q 11/0046 173/75
2011/0239398 A1* 10/2011 Furusawa ..... A47L 9/2884 15/339
2011/0308830 A1* 12/2011 Furusawa ..... B25F 5/003 173/198
2012/0234570 A1 9/2012 Machida et al.
2012/0255756 A1* 10/2012 Aoki ..... B25D 16/003 173/178
2012/0298391 A1* 11/2012 Kakiuchi ..... B23Q 11/0046 173/77
2013/0031879 A1* 2/2013 Yoshikane ..... B23Q 11/0046 55/356
2013/0031881 A1* 2/2013 Machida ..... B23Q 11/0046 55/385.1
2013/0055523 A1* 3/2013 Yoshikane ..... B23Q 11/0046 15/347
2013/0055527 A1* 3/2013 Machida ..... A47L 9/2842 15/415.1
2013/0068255 A1* 3/2013 Heger ..... B23Q 11/0046 134/18
2013/0136549 A1* 5/2013 Appel ..... B23Q 17/00 408/56
2013/0183111 A1* 7/2013 Lerch ..... B23Q 11/0046 408/56
2013/0213683 A1* 8/2013 Brewster ..... B23Q 11/0046 173/198
2014/0261551 A1* 9/2014 Usselman ..... B23Q 11/0046 134/18
2016/0151846 A1* 6/2016 Suzuki ..... B24B 55/00 340/12.5
2017/0232565 A1* 8/2017 Machida ..... B23Q 11/0046 173/198

FOREIGN PATENT DOCUMENTS

CN 102448676 A 5/2012
CN 102596508 A 7/2012
CN 102672682 A 9/2012
CN 102791436 A 11/2012
JP 2003-340620 A 12/2003
JP 2009-12152 A 1/2009
JP 2009-136971 A 6/2009
JP 2011-093073 A 5/2011
JP 2015-150664 A 8/2015
WO WO2010/0137446 A1 12/2010
WO WO-2015122539 A1 * 8/2015 ..... B25F 5/00

OTHER PUBLICATIONS

International Search Report for international application PCT/JP2017/002951 (dated Jan. 27, 2017) 10 pages with translation.
International Report on Patentability for application PCT/JP2017/002951 (dated Aug. 28, 2018), 10 pages.
China Patent Office office action for patent application 201780012413.3 (dated Nov. 26, 2020), 18 pages with translation.

* cited by examiner

WORK TOOL

TECHNICAL FIELD

The present invention relates to a work tool and, more particularly, to a work tool having a main body to which an attachment device is connectable.

BACKGROUND ART

Conventionally, there are widely known work tools each configured to rotate and/or move an end bit, by driving force of a motor, to form a drill hole in a work piece or to apply an impact force to a work piece such as concrete. Among such work tools, there is also known a work tool having a tool main body to which an attachment device suitable for a work purpose is detachably attachable. For example, Patent Literature 1 discloses a drilling tool whose main body is detachably attachable with a dust collector as an example of such an attachment device.

CITATION LIST

[Patent Literature 1] Japanese Patent Application Publication No. 2009-136971

SUMMARY OF INVENTION

Technical Problem

An attachment device is connected to a main body of the tool when used. However, the tool main body and the attachment device connected thereto may not work well in cooperation with each other. Rather, in some cases, connection of the attachment device may result in deterioration in working efficiency.

The present invention has been made in view of the foregoing, and it is an object of the present invention to provide a work tool capable of realizing good cooperation between a tool main body and an attachment device connected thereto, for improving working efficiency.

Solution to Problem

In order to attain the above and other objects, the present invention provides a work tool including a main body and a controller configured to perform control over the main body. The main body includes a drive source and a work part configured to be driven by the drive source to perform a work. An attachment device is connectable to the main body. The controller is configured to: detect whether or not a connection of the attachment device to the main body is established; and change the control over the main body depending on whether or not the connection is established.

With this configuration, the controller is configured to appropriately change the control over the main body between a case where the attachment device is connected to the main body and a case where the attachment device is not connected to the main body. A suitable control over the main body can be realized depending on whether the main body is used alone or the main body is used with the attachment device connected thereto, thereby leading to enhancement of work efficiency.

In the configuration described above, it is preferable that: the main body further includes assisting means for assisting the work; and the controller is configured to further control an active state/non-active state of the assisting means depending on whether or not the connection is established.

With this configuration, the controller is configured to appropriately change whether or not the assisting means should be activated during a work depending on whether the main body is used alone or the main body is used with the attachment device connected thereto. Hence, the operation state of the assisting means while the work part is performing the work can be suitably controlled depending on whether or not the connection of the attachment device is available or not, thereby leading to improvement of working efficiency. Further, because the assisting means is put in the non-active state in which the assisting means is not activated during the work, power consumption can be reduced.

Further, in the configuration described above, it is preferable that: the controller places the assisting means in the active state in a case where the attachment device is not connected to the main body; and the controller places the assisting means in the non-active state in a case where the attachment device is connected to the main body.

With this configuration, such assisting means that need not be activated during a work or that may, if activated, deteriorate working efficiency of a work performed while being connected is configured to be activated only when the main body is used alone to perform the work, but not to be activated when the attachment device is connected. Accordingly, work efficiency during the connection of the attachment device can be enhanced, and an operator can perform the work comfortably. Further, since the assisting means that is not required to perform a work in the state where the attachment device is connected can be deactivated, power consumption can be reduced.

Further, in the configuration described above, it is preferable that: the assisting means is lighting means capable of irradiating light toward a work spot at which the working part performs the work; the attachment device is positioned between the lighting means and the work spot when connected to the main body; the controller places the lighting means in the active state during the work in the case where the attachment device is not connected to the main body; and the controller places the lighting means in the non-active state during the work in the case where the attachment device is connected to the main body.

With this configuration, the lighting means is turned off during a work performed in the state where the attachment device is connected. Thus, the connected attachment device neither bocks light of the lighting means, nor reflect the light in an unintended direction. Accordingly, work efficiency can be enhanced, and an operator can perform the work comfortably. Further, since the lighting means is configured not to be lit during a work performed when the attachment device is connected, power consumption can be reduced.

Further, preferably, the controller is configured to change control over driving of the driving source depending on whether or not the connection is established.

With this configuration, the controller is configured to appropriately change the control over the driving of the drive source between the case where the attachment device is connected to the main body and the case where the attachment device is not connected to the main body. Hence, a suitable control over the driving of the drive source can be realized depending on whether the main body is used alone or the main body is used with the attachment device connected thereto. Accordingly, when the attachment device is connected to the main body, the main body and the attachment device can suitably operate in cooperation with each other, thereby leading to enhancement of work efficiency.

Further, in the configuration described above, it is preferable that: the main body further includes a manipulation part configured to be subjected to a manual operation for controlling a start/stop of the drive source; the drive source is a motor; in a case where the attachment device is not connected to the main body, the controller causes a rotation speed of the motor to reach a target rotation speed after a lapse of a first time period from a timing when a starting operation is performed to the manipulation part; and, in a case where the attachment device is connected to the main body, the controller causes the rotation speed of the motor to reach the target rotation speed after a lapse of a second time period longer than the first time period from the timing when the starting operation is performed to the manipulation part.

With this configuration, normally, a certain time lag is generated from a timing when the attachment device is connected to the main body until a timing when the attachment device is driven fully enough to assist the work performed by the work part. However, a time period required for the rotation speed of the motor to reach the target rotation speed when the attachment device is connected is set longer than the time period required when the attachment device is not connected. Accordingly, the timing at which the connected attachment device is driven fully can be brought closer to the timing at which the rotation speed of the motor reaches the target rotation speed. Hence, it is unlikely that the motor of the main body is started to be driven to start the work before the attachment device is driven sufficiently.

Further, in the configuration described above, it is preferable that: the controller sets a maximum rotation speed of the drive source to a first rotation speed in the case where the attachment device is not connected to the main body; and the controller sets the maximum rotation speed of the drive source to a second rotation speed lower than the first rotation speed in the case where the attachment device is connected to the main body.

With this configuration, the controller makes the maximum rotation speed of the drive source lower when the attachment device is connected to the main body than when the attachment device is not connected. Accordingly, an amount of dust or the like generated as a result of the work by the work part can be reduced. This configuration is particularly effective in a case where a large amount of dust is assumed to be generated during the work, or in a case where a dust collector is connected to the main body as the attachment device.

Further, in the configuration described above, it is preferable that: the controller stops the attachment device after halting the drive source in a case where a stop operation is performed to the manipulation part.

With this configuration, when the stop operation is performed to the manipulation part, the attachment device is caused to stop after the drive source is halted. Normally, the work part is kept being driven for a while by inertia even after the drive source is stopped driving. Because the attachment device is configured to stop being driven after the driving of the drive source is halted, the attachment device can fully assist the work performed by the work part due to the inertia after the driving of the drive source is halted.

In particular, in a case where the attachment device is a dust collector configured to collect the dust generated as a result of the work, the above configuration is particularly effective because dust or the like generated until the work part comes to a complete stop after the drive source is stopped can be reliably disposed. Further, in a configuration where the drive source and the dust collector are to be stopped substantially at the same time as each other, the dust collector may be stopped before the sucked dust and the like is collected in a dust-collection case, with the dust left within the dust collector. In contrast, because the dust collector is caused to stop after the drive source is halted, the dust remaining in the dust collector can be reliably collected in the dust-collection case.

Further, it is preferable that: the main body further comprises an acceleration sensor configured to detect an acceleration of the main body; and the controller is configured to stop driving the drive source in a case where the acceleration detected by the acceleration sensor exceeds an acceleration threshold value.

With this configuration, the drive source is forced to stop being driven in the case where the acceleration of the main body exceeds the acceleration threshold value, for example, due to stall of the work part. Therefore, an excessive load is less likely to be impacted on the main body.

In the configuration described above, it is further preferable that the controller is configured to change the acceleration threshold value depending on whether or not the connection is established.

With this configuration, the acceleration threshold value can be set suitably depending on whether the main body is used alone or the main body is used with the attachment device connected thereto. Therefore, an excessive load is further less likely to be impacted on the main body.

Further, it is preferable that: the attachment device includes an attachment-device motor configured to be driven upon receipt of power supply from the main body in a state where the attachment device is connected to the main body, and switching means switchable between a first state allowing the power supply to the attachment-device motor and a second state interrupting the power supply; the main body includes a signal line connected to the switching means in the state where the attachment device is connected to the main body; the controller outputs, to the switching means, a control signal for bringing the switching means into the first state through the signal line to detect whether or not the attachment device is connected to the main body using the signal line.

With this configuration, the signal line for outputting the control signal can also be used to detect the connection of the attachment device. Therefore, there is no need to provide another signal line for the connection detection in addition to the signal line for outputting the control signal. Hence, the number of components required to manufacture the work tool can be reduced, thereby leading to lower manufacturing costs and improvement in assembly performance.

In the configuration described above, it is further preferable that: the attachment device further includes an attachment-device-side resistor connected to the signal line in the state where the attachment device is connected to the main body; the signal line includes a main-body-side resistor, one end of the main-body-side resistor being connected to the controller and another end of the main-body-side resistor being connected to the attachment-device-side resistor in the state where the attachment device is connected to the main body; and the controller detects whether or not the connection of the attachment device to the main body is established based on a value of a divided voltage divided by the attachment-device-side resistor and the main-body-side resistor.

With this configuration, the connection of the attachment device to the main body can be detected through a simple circuit architecture, without using complicated circuits.

Hence, reduction in manufacturing costs and further improvement of assembly performance can be obtained.

Further, it is preferable that the attachment device is a dust collector configured to generate negative pressure at a work spot at which the work is performed by the work part.

With this configuration, even if the dust or the like is generated as a result of the work performed by the work part, the dust collector connected to the main body can suck and collect the generated dust, by utilizing the negative pressure. Thus, working efficiency can be enhanced.

Further, preferably, the work wool is a drilling tool.

In a case where the work tool is configured as a drilling tool that may generate a large amount of dust by the work of the work part, connecting, as the attachment device, a dust collector capable of sucking the generated dust to the main body can particularly improve working efficiency.

Advantageous Effects of Invention

According to the work tool of the present invention, a tool main body and an attachment device connected thereto can suitably work in cooperation with each other, and, hence, working efficiency can be enhanced.

DESCRIPTION OF EMBODIMENT

Hereinafter, one embodiment in which a work tool according to the present invention is applied to a cordless-type hammer drill 1 will be described in detail based on FIGS. 1 through 9.

Figure 1:
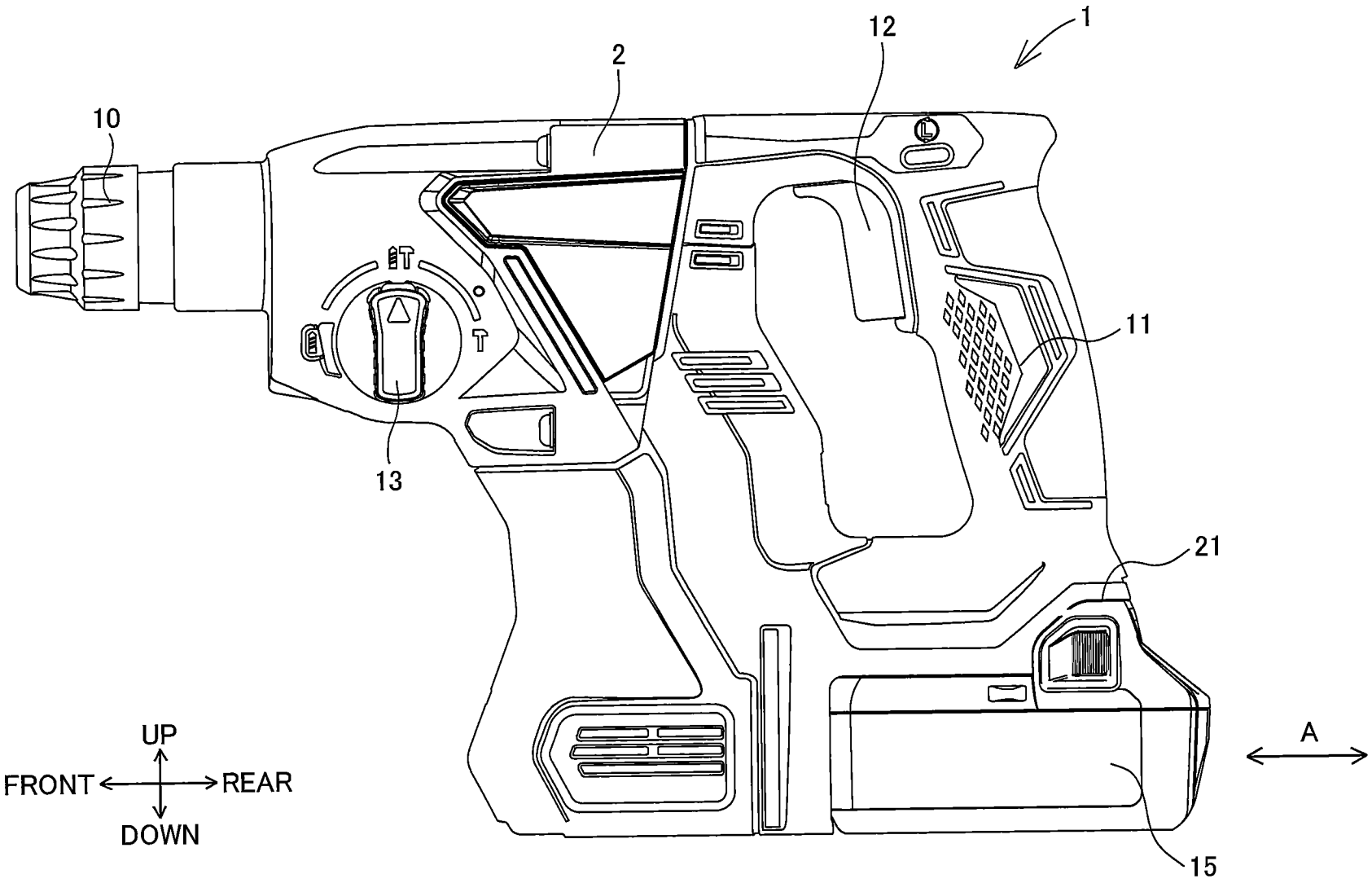
FIG. 1 is a left side view illustrating an exterior of a hammer drill according to one embodiment of the present invention.

The hammer drill 1 according to the present embodiment includes a main body 2 constituting an outer contour of the hammer drill 1. As illustrated in FIG. 1, the main body 2 of the hammer drill 1 has one end portion (front end portion) at which an end-bit mount portion 10 is provided. To the end-bit mount portion 10, an end bit 14 suitable for a work purpose, such as a drill blade, can be attached (see FIG. 2). At another end portion of the main body 2 opposite to the one end portion at which the end-bit mount portion 10 is provided (rear end portion), a handle 11 is provided so that an operator can grip the same. The handle 11 is provided with a trigger switch 12 as an example of a manipulation part that the operator can manually operate. Incidentally, a side handle (not illustrated) is further attachable to the main body 2 for operations with both hands, depending on work purposes.

Figure 3:
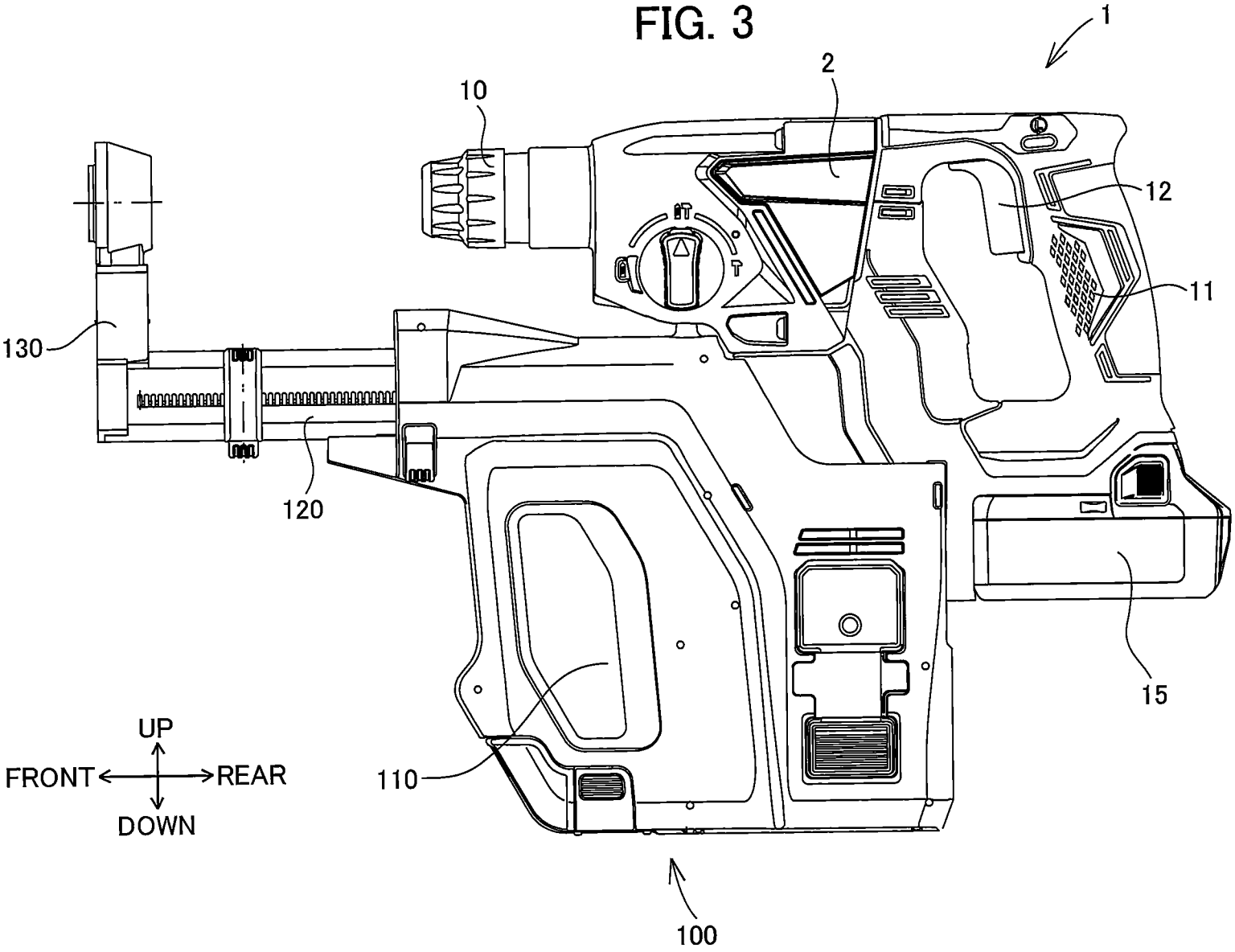
FIG. 3 is an external view illustrating a state where a dust collector is connected to the main body of the hammer drill according to the embodiment of the present invention.

Further, a dust collector 100 as an example of an attachment device is detachably connectable to the main body 2 (see FIG. 3). That is, the hammer drill 1 can be used in a state where the dust collector 100 is connected to the main body 2, or can be used alone with the dust collector 100 detached from the main body 2.

Hereinafter, the "front", "rear", "upward" and "downward" indicated by arrows in FIG. 1 are defined as a front side, a rear side, an upper side, and a lower side of the hammer drill 1. Further, the left when the hammer drill 1 is viewed from its rear side is defined as a left side of the hammer drill 1, and the right as a right side thereof.

As illustrated in FIG. 1, a battery attachment portion 21 is provided below the handle 11 of the main body 2. A battery 15 for supplying power to drive a motor 3 (to be described later) can be attached to and detached from the battery attachment portion 21. Specifically, as indicated by a double-headed arrow A in FIG. 1, the battery 15 can be attached and detached relative to the battery attachment portion 21 in a front-rear direction of the main body 2. In the present embodiment, two types of batteries 15 can be attached to the battery attachment portion 21 according to work purposes: one type of the battery 15 having an output voltage of 18 V, and the other type of the battery 15 having an output voltage of 36 V. In the present embodiment, the battery 15 is a battery pack configured of a plurality of secondary battery cells for power tools.

In a state where the battery 15 is attached to the battery attachment portion 21, the operator holds the handle 11 and operates the trigger switch 12 while the end bit 14 mounted on the end-bit mount portion 10 is in abutment with a work piece. Thus, the hammer drill 1 can be driven cordlessly. The end-bit mount portion 10 and the end bit 14 mounted on the end-bit mount portion 10 are an example of a "work part" of the present invention.

A switch 13 is provided on a left side surface of the main body 2 for switching an operation mode of the hammer drill 1. By operator's operation to the switch 13, the operation mode of the hammer drill 1 can be switched to one from among the following operation modes: a rotational-impacting mode; an impacting mode; and a rotation mode.

Figure 6:
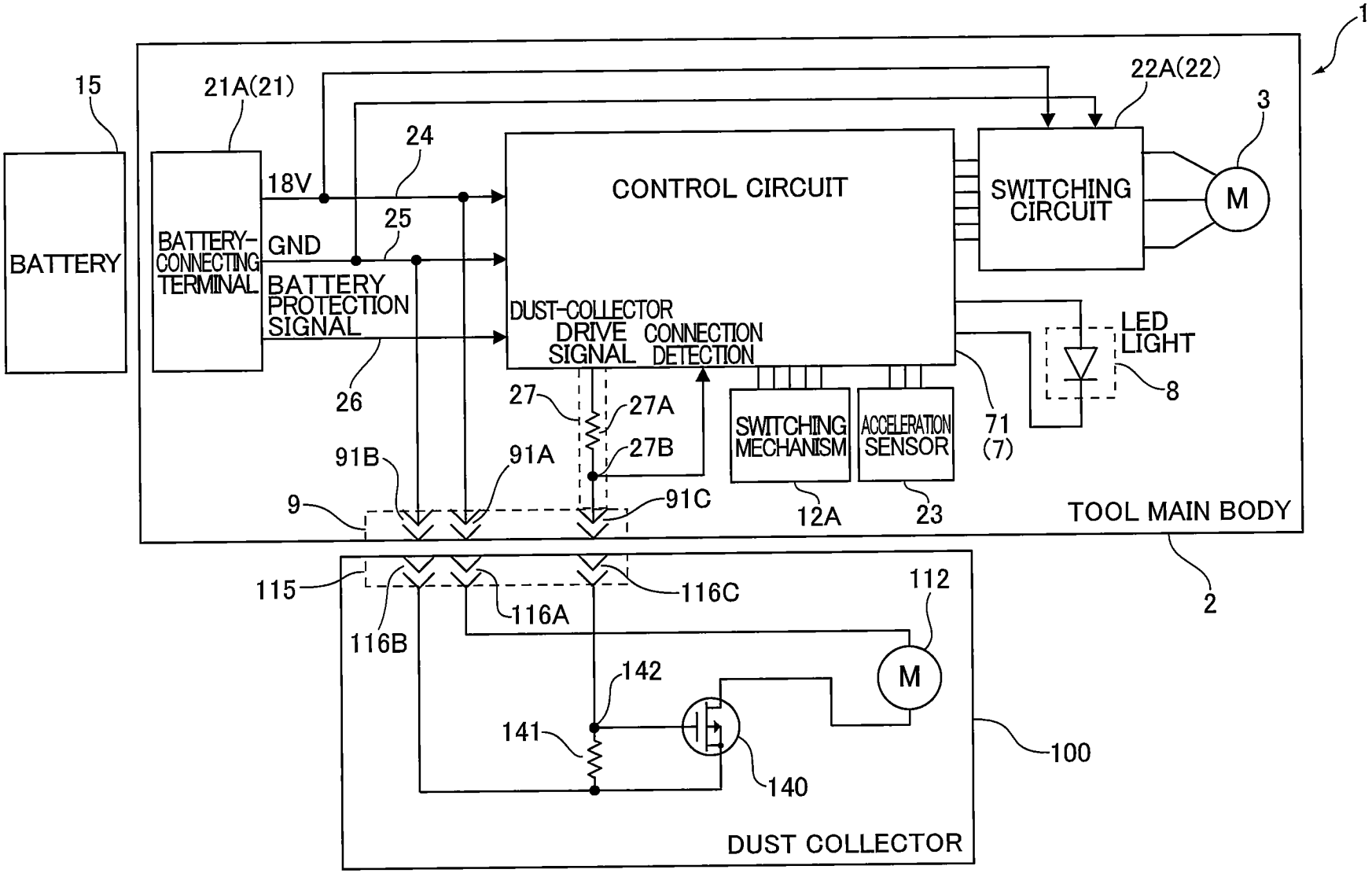
FIG. 6 is a schematic circuit diagram including a block diagram illustrating electrical configurations of the hammer drill according to the embodiment of the present invention.

The battery attachment portion 21 includes a battery-connecting terminal part 21A (see FIG. 6). The battery-connecting terminal part 21A includes a plurality of terminals (not illustrated) electrically connectable to the battery 15 when the battery 15 is attached to the main body 2.

Inside the handle 11 provided is a switching mechanism 12A electrically connected to the trigger switch 12 and a control substrate part 7 (to be described later). When the trigger switch 12 is pulled, i.e., subjected to a starting operation (for example, when the trigger switch 12 is pushed toward the inside of the handle 11 by an operator's finger), the switching mechanism 12A outputs a start-up signal for starting the motor 3 to the control substrate part 7. Further, when the trigger switch 12 is released from being pulled, i.e., subjected to a stop operation (for example, when the operator detaches the finger from the trigger switch 12 to release the pulling operation), the switching mechanism 12A stops outputting the start-up signal.

Figure 2:
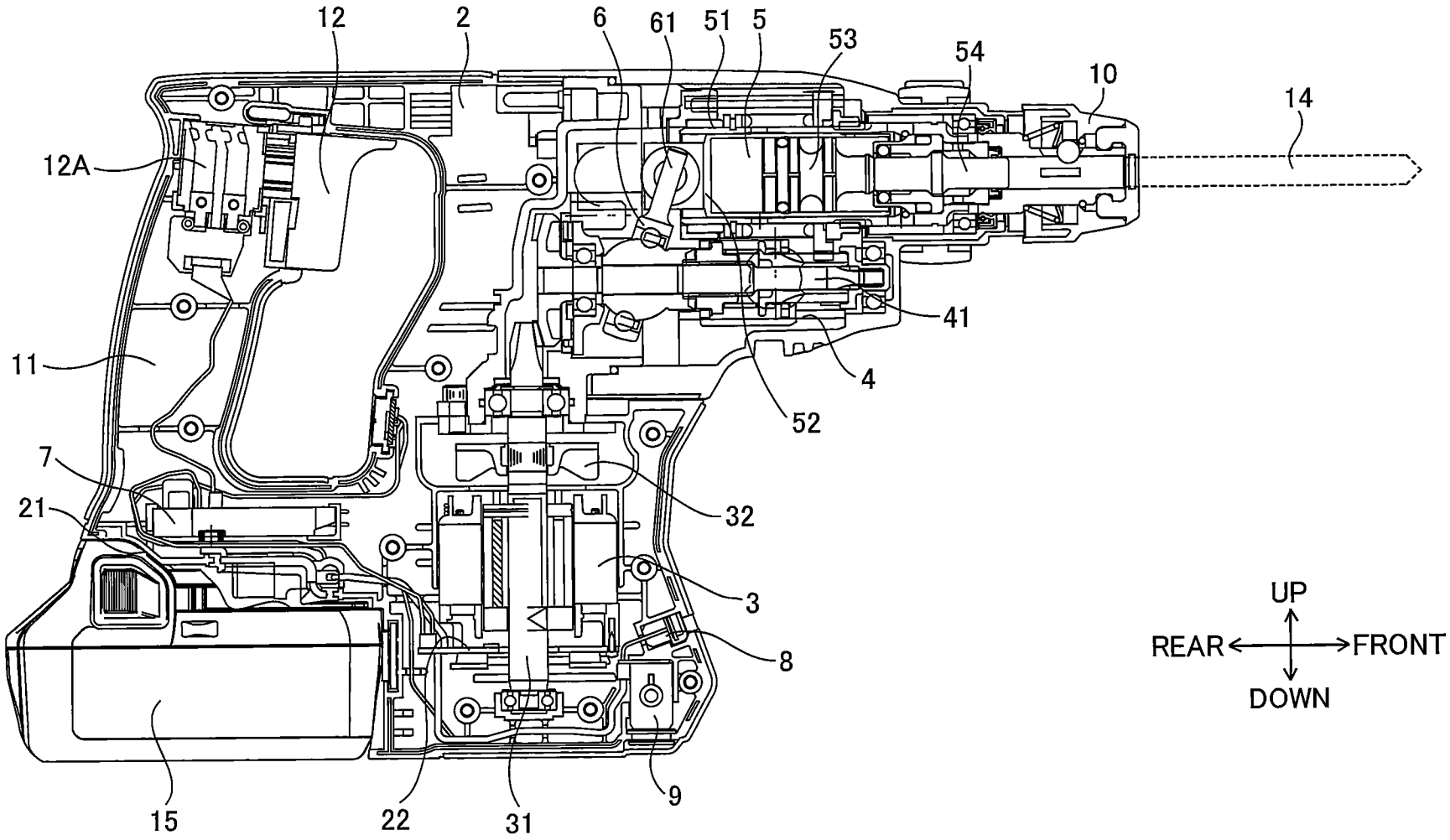
FIG. 2 is a vertical cross-sectional view illustrating an internal structure of a main body of the hammer drill according to the embodiment of the present invention.

As illustrated in FIG. 2, the motor 3, a switching circuit board 22, a drive-transmission part 4, an impact mechanism part 5, a reciprocating-movement conversion part 6, the control substrate part 7, a light part 8, and a power-supply part 9 are accommodated inside the main body 2.

The motor 3 is an example of a drive source. The motor 3 is housed in a lower portion of the main body 2. The motor 3 is a brushless motor serving as a drive source for the hammer drill 1. The motor 3 is configured to be driven upon receiving power supplied from the battery 15 attached to the battery attachment portion 21. The motor 3 is disposed with a rotation shaft 31 thereof oriented in a vertical direction. The motor 3 is rotatably supported by the main body 2. A fan 32 is fixed to an upper end portion of the rotation shaft 31 of the motor 3.

The switching circuit board 22 is a board having a ring shape in a bottom view. The switching circuit board 22 includes a switching circuit 22A (see FIG. 6) for driving the motor 3. The switching circuit board 22 is disposed below the motor 3. A lower end portion of the rotation shaft 31 is inserted in a through-hole formed at a substantially center portion of the switching circuit board 22 in a bottom view to penetrate the same vertically. Details of the switching circuit 22A will be described later.

The drive-transmission part 4 is disposed above the motor in the main body 2. The drive-transmission part 4 includes an intermediate shaft 41 extending in the front-rear direction. The intermediate shaft 41 is rotatably supported with respect to the main body 2. The intermediate shaft 41 is connected to the rotation shaft 31 of the motor 3 through a plurality of gears so that the intermediate shaft 41 can rotate in response to receiving a rotational force from the motor 3.

The impact mechanism part 5 is disposed above the drive-transmission part 4 in the main body 2. The impact mechanism part 5 includes a cylinder 51, a piston 52, an impact member 53 and an intermediate member 54.

The cylinder 51 has a substantially cylindrical shape extending in the front-rear direction. The cylinder 51 is supported at an upper portion of the main body 2 so as to be rotatable relative to the main body 2. The cylinder 51 is engageable with the intermediate shaft 41 of the drive-transmission part 4. The cylinder 51 is thus rotatable upon receiving a rotational force from the intermediate shaft 41 when engaged with the intermediate shaft 41. The cylinder 51 has a distal end portion (front end portion) that is accommodated inside the end-bit mount portion 10.

The piston 52 has a substantially cylindrical shape extending in the front-rear direction. The piston 52 is slidably movably disposed within the cylinder 51. The impacting member 53 is disposed within the piston 52 so as to be slidably movable in the front-rear direction. The intermediate member 54 is disposed forward of the impacting member 53 within the cylinder 51 so as to be slidably movable in the front-rear direction. The impacting member 53 has a front end that can abut against a rear end of the intermediate member 54, while the intermediate member 54 can abut against a rear end of the end bit 14 mounted on the end-bit mount portion 10.

The reciprocating-movement conversion part 6 is arranged to connect the drive-transmission part 4 to the impact mechanism part 5. The reciprocating-movement conversion part 6 includes an arm 61. The arm 61 extends in a direction crossing the intermediate shaft 41 and the cylinder 51. The arm 61 has an upper end portion connected to a rear end portion of the piston 52, and a lower end portion connected to a rear portion of the intermediate shaft 41 through a plurality of balls. With this structure, the arm 61 can convert the rotational force of the motor 3 transmitted thereto through the intermediate shaft 41 into a linear reciprocating movement in the front-rear direction, and transmit the linear reciprocating movement to the piston 52. The reciprocating movement of the arm 61 causes the piston 52 to reciprocate in the front-rear direction within the cylinder 51. While air inside the cylinder 51 is being compressed and expanded by the reciprocating movement of the piston 52, the impacting member 53 is caused to reciprocate in the front-rear direction. The reciprocating movement of the impacting member 53 then causes the front end of the impacting member 53 to abut against the rear end of the intermediate member 54 to strike the intermediate member 54. When the intermediate member 54 is struck, the front end of the intermediate member 54 then hits the rear end of the end bit 14 attached to the end-bit mount portion 10. In this manner, an impacting (striking) force is imparted to the end bit 14.

The rotational force (drive force) of the motor 3 is transmitted to the impact mechanism part 5 as a rotational force, an impacting force, or a rotational-impacting force by the drive-transmission part 4 and/or the reciprocating-movement conversion part 6 being driven either simultaneously or selectively. With this configuration, the three operation modes of the hammer drill 1 can be achieved.

The control substrate part 7 is disposed above the battery attachment portion 21. The control substrate part 7 includes a control circuit 71 (see FIG. 6) configured to perform various controls for the main body 2. The control circuit 71 is an example of a "controller" of the present invention. Details of the control circuit 71 will be described later.

The light part 8 is disposed forward and downward of the motor 3 in the main body 2. The light part 8 is arranged to have a distal end (front end part) thereof exposed from a front surface of the main body 2. In the present embodiment, the light part 8 is configured as an LED light. The light part 8 is electrically connected to the control substrate part 7. The control substrate part 7 can thus provide control over lighting-on/lighting-off (activation/non-activation) of the light part 8. While lighting, the light part 8 can emit LED light in a substantially upper-front direction of the main body 2, i.e., toward a position where the end bit 14 applies machining to the work piece (work spot). The light part 8 is an example of "assisting means" and "lighting means" of the present invention.

In the present embodiment, when the hammer drill 1 is used alone, the light part 8 is placed in a light-on state (active state) by the control substrate part 7 to emit LED light toward the work spot near a tip end of the end bit 14. This ensures operator's visibility during working. On the other hand, in a state where the dust collector 100 is connected to the main body 2, the dust collector 100 is positioned between the light part 8 and the end bit 14, as illustrated in FIG. 3. That is, the connected dust collector 100 is positioned on a light path of the LED light of the light part 8, i.e., at a position blocking the LED light. Hence, in the present embodiment, when the dust collector 100 is connected to the main body 2, the light part 8 is controlled by the control substrate part 7 to be put in a light-off state (non-active state) so as not to emit the LED light. Details will be described later.

Figure 5:
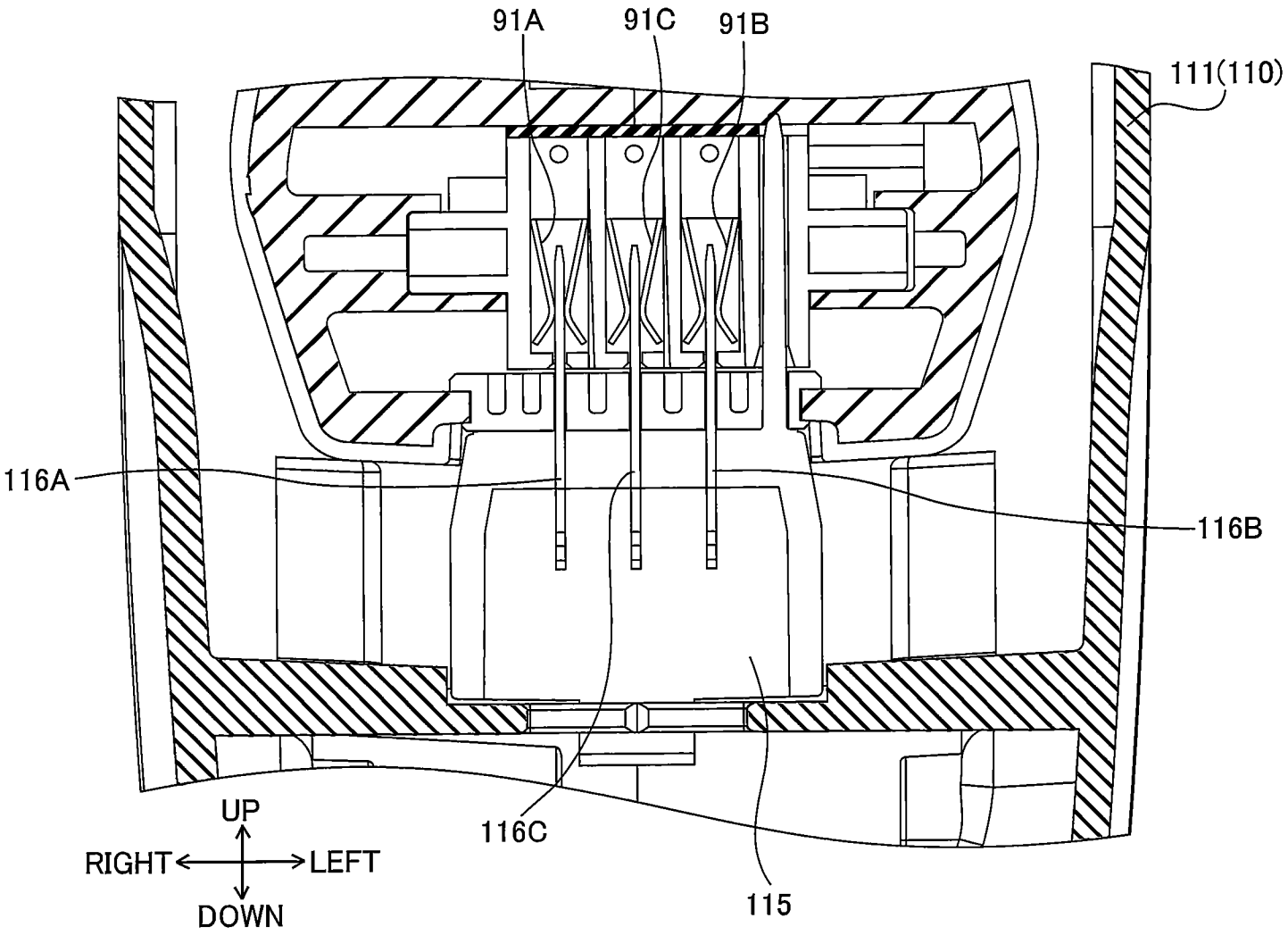
FIG. 5 is a partially enlarged cross-sectional view illustrating a state where terminals of the dust collector are inserted in terminals of the hammer drill according to the embodiment of the present invention.

The power-supply part 9 is provided below the light part 8 and at a lower-front end portion of the main body 2. As illustrated in FIG. 5, the power-supply part 9 includes a main-body-side positive terminal 91A, a main-body-side negative terminal 91B, and a main-body-side signal terminal 91C. The power-supply part 9 is configured to be connected to a collector-side terminal portion 115 (to be described later) of the dust collector 100 in a state where the dust collector 100 is connected to the main body 2. By the connection between the power-supply part 9 of the main body 2 and the collector-side terminal portion 115 of the dust collector 100, power can be supplied from the main body 2 to the dust collector 100 through the power-supply part 9; and the control substrate part 7 can have control over operations of the dust collector 100.

Further, an acceleration sensor 23 is provided in the main body 2 (see FIG. 6). The acceleration sensor 23 is electrically connected to the control substrate part 7 and is configured to detect acceleration of the main body 2. The acceleration sensor 23 is configured to output an acceleration signal corresponding to the acceleration of the main body 2 to the control substrate part 7.

As illustrated in FIG. 3, the dust collector 100 is detachably connectable to the main body 2 having the above configuration. The dust collector 100 is a device for sucking and collecting dusts generated from a work piece as a result of rotation/impacting of the end bit 14 such as a drill blade against the work piece. By connecting the dust collector 100 to the main body 2, efficiency in working such as drilling performed by the hammer drill 1 can be expected to improve. In the present embodiment, the dust collector 100 is connected to the main body 2 of the hammer drill 1 from below.

Next, a configuration of the dust collector 100 will be described with reference to FIGS. 3 through 5.

Figure 4:
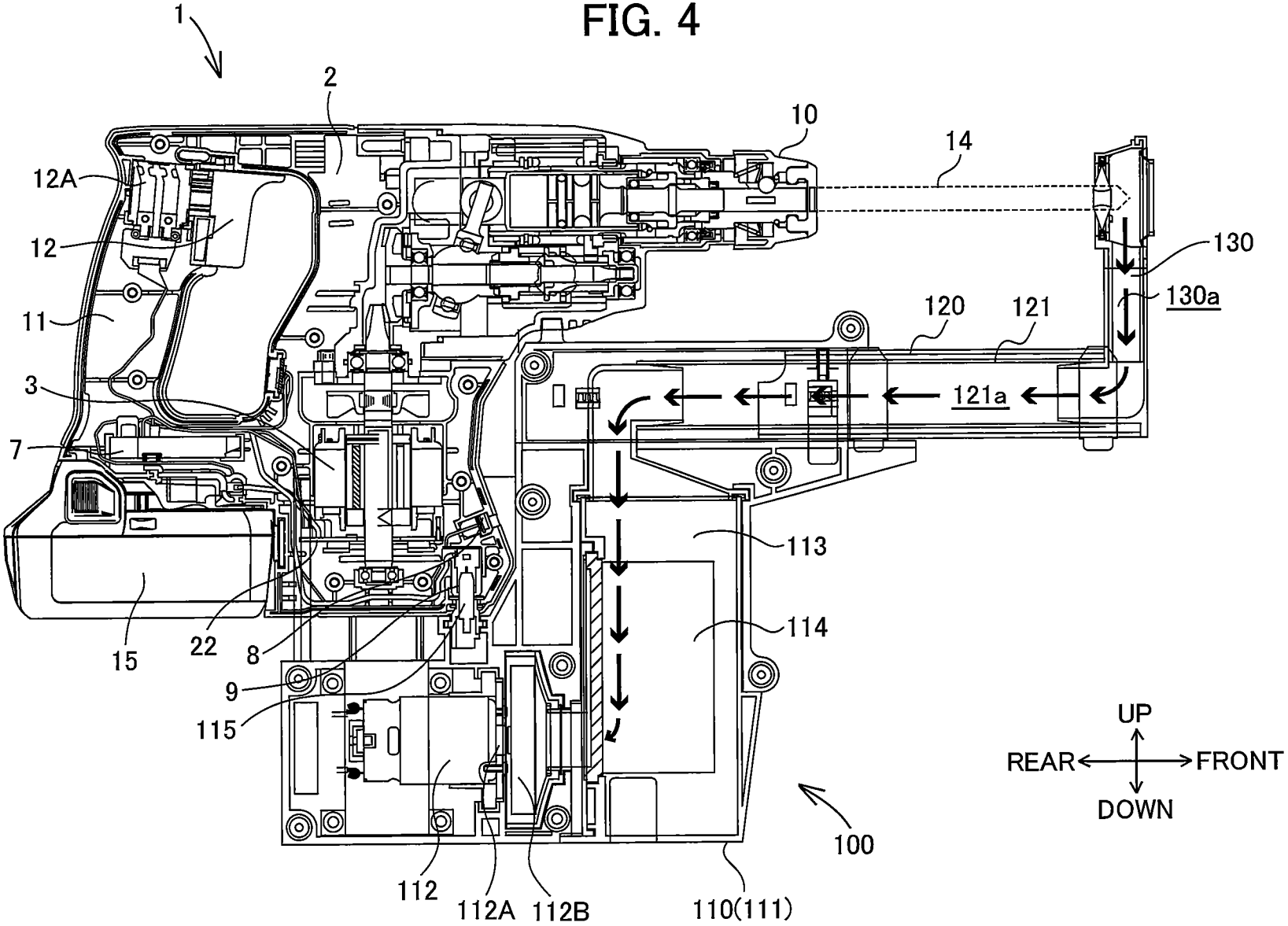
FIG. 4 is a vertical cross-sectional view illustrating an internal structure in the state where the dust collector is connected to the main body of the hammer drill according to the embodiment of the present invention.

As illustrated in FIGS. 3 and 4, the dust collector 100 mainly includes a body portion 110, a slider portion 120, and an adaptor portion 130.

The body portion 110 includes a housing 111 constituting an outer contour thereof. In the housing 111, a collector motor 112 serving as a drive source of the dust collector 100, and a dust-collection case 113 collecting the sucked dust are accommodated. Further, the collector-side terminal portion 115 is provided at a rear portion of the housing 111.

The collector motor 112 is disposed at the rear portion of the housing 111. The collector motor 112 has a rotation shaft 112A oriented in the front-rear direction. The collector motor 112 is supported by the housing 111 so as to be rotatable relative to the housing 111. A fan 112B is fixed to a front end of the rotation shaft 112A of the collector motor 112. By the collector motor 112 being driven to rotate the fan 112B, a suction force of the dust collector 100 is generated. The collector motor 112 is an example of an "attachment-device motor" of the present invention.

The collector-side terminal portion 115 is provided at the rear portion of the housing 111 to protrude upward from an upper surface thereof. As illustrated in FIG. 5, the collector-side terminal portion 115 includes a collector-side positive terminal 116A, a collector-side negative terminal 116B, and a collector-side signal terminal 116C in one-to-one correspondence with the three terminals of the power-supply part 9 of the main body 2.

When the dust collector 100 is connected to the main body 2 of the hammer drill 1, the collector-side positive terminal 116A is received by the main-body-side positive terminal 91A; the collector-side negative terminal 116B is received by the main-body-side negative terminal 91B; and the collector-side signal terminal 116C is received by the main-body-side signal terminal 91C. That is, in a state where the dust collector 100 is connected to the main body 2, the collector-side positive terminal 116A is connected to the main-body-side positive terminal 91A; the collector-side negative terminal 116B is connected to the main-body-side negative terminal 91B; and the collector-side signal terminal 116C is connected to the main-body-side signal terminal 91C. The main body 2 and the dust collector 100 are thus electrically connected to each other through the power-supply part 9 and the collector-side terminal portion 115.

The dust-collection case 113 is disposed forward of the collector motor 112 in the housing 111. The dust-collection case 113 can be detachably attached to the body portion 110 (housing 111). Thus, the dust-collection case 113 can be taken out of the housing 111 for disposal of the dust when the collected dust has been accumulated to some extent. The dust-collection case 113 is provided with a filter 114. The filter 114 is positioned to oppose the fan 112B fixed to the front end of the rotation shaft 112A of the collector motor 112 when the dust-collection case 113 is attached to the body portion 110.

The slider portion 120 is supported by a front portion of the body portion 110 so as to be slidable in the front-rear direction relative thereto. Movement of the slider portion 120 in the front-rear direction is guided by a guide mechanism (not illustrated) formed in an inner side wall of the housing 111. That is, the slider portion 120 is received in the body portion 110 when being moved rearward, and protrudes forward from the body portion 110 when being moved forward. As illustrated in FIG. 4, the slider portion 120 has a hollow space therein, and a hose 121 is accommodated in the hollow space. The hose 121 can expand and contract in the front-rear direction in association with the sliding movement of the slider portion 120 in the front-rear direction. The hose 121 defines a space 121*a* therein. The space 121*a* inside the hose 121 communicates with an internal space of the dust-collection case 113 attached to the body portion 110.

The adaptor portion 130 is provided to extend upward from a front end portion of the slider portion 120. The adaptor portion 130 is a portion that is pressed against the work piece during working. An opening (not illustrated) is formed at a tip end portion of the adaptor portion 130, and the adaptor portion 130 defines a space 130*a* therein in communication with the opening. The space 130*a* communicates with the space 121*a* inside the hose 121 of the slider portion 120.

In the dust collector 100 having the above configuration, dust sucked from the opening (not illustrated) formed in the tip end portion of the adaptor portion 130 is carried to the dust-collection case 113 through the space 121*a* in the hose 121 of the slider portion 120, and then accumulated within the dust-collection case 113. The dust in the sucked air is caught by the filter 114 provided in the dust-collection case 113, so that the sucked dust is reliably accumulated in the dust-collection case 113 without being moved toward the collector motor 112. The air filtered by the filter 114 is exhausted outside the dust collector 100 from an exhaust port (not illustrated) formed in the vicinity of the fan 112B.

Next, electrical configurations of the hammer drill 1 and dust collector 100 will be described with reference to FIG. 6. FIG. 6 is a circuit diagram including a block diagram illustrating the electrical configurations of the hammer drill 1 and dust collector 100.

First, the electrical configuration of the hammer drill 1 will be described. As illustrated in FIG. 6, the main body 2 of the hammer drill 1 includes a positive line 24, a GND line 25, a first signal line 26 and a second signal line 27, in addition to the above-described battery-connecting terminal part 21A, power-supply part 9, switching circuit 22A, motor 3, control circuit 71, switching mechanism 12A, acceleration sensor 23, and light part 8.

One end of each of the positive line 24, GND line 25 and first signal line 26 is connected to the battery-connecting terminal part 21A, while another end of each of the positive line 24, GND line 25 and first signal line 26 is connected to the control circuit 71. In a state where the battery 15 is attached to the battery attachment portion 21, a voltage of the battery 15 (18 V in the present embodiment) is applied across the positive line 24 and the GND line 25. When the battery 15 outputs a battery-protection signal, the battery-protection signal is inputted to the control circuit 71 through the first signal line 26. In this case, the control circuit 71 stops the motor 3.

The second signal line 27 connects the main-body-side signal terminal 91C of the power-supply part 9 to the control circuit 71. The second signal line 27 includes a main-body-side voltage dividing resistor 27A. The main-body-side voltage dividing resistor 27A is provided on the second signal line 27. The second signal line 27 has one end connected to the control circuit 71, and another end connected to the main-body-side signal terminal 91C. A node 27B between the main-body-side voltage dividing resistor 27A on the second signal line 27 and the main-body-side signal terminal 91C is connected to the control circuit 71. The second signal line 27 is an example of a "signal line" of the present invention. The main-body-side voltage dividing resistor 27A is an example of a "main-body-side resistor" of the present invention.

The main-body-side positive terminal 91A and the main-body-side negative terminal 91B of the power-supply part 9 are connected to the positive line 24 and the GND line 25, respectively.

The switching circuit 22A is a circuit configured to supply power of the battery 15 to the motor 3. The switching circuit 22A is connected between the positive line 24 and GND line 25 and the motor 3. The switching circuit 22A includes six switching elements (not illustrated). In the present embodiment, these six switching elements are six FETs. The six FETs are connected in a three-phase bridge configuration, with each gate thereof connected to the control circuit 71; and with each drain or source thereof connected to the motor 3. The six switching elements (FETs) perform switching operations to rotate the rotation shaft 31 of the motor 3 in a predetermined rotation direction based on drive signals (gate signals) outputted from the control circuit 71.

The control circuit 71 is a circuit configured to perform a main body control of the hammer drill 1. The control circuit 71 includes: a CPU for performing arithmetic operations based on a process program and various data used for the main body control; a ROM (not illustrated) for storing the process program, various data and various threshold values; a memory including a RAM (not illustrated) for temporarily storing data; and a timing part for measuring time. In the present embodiment, the control circuit 71 includes a microcomputer.

The control circuit 71 is configured to control the driving of the motor 3 as the main body control. In controlling the driving of the motor 3, on the basis of a rotational position signal outputted from a rotational position detection circuit (not illustrated), the control circuit 71 outputs, to the switching circuit 22A, drive signals for sequentially switching FETs to be rendered ON among the six FETs, thereby rotating the rotating shaft 31 of the motor 31 in the predetermined rotation direction. Further, the control circuit 71 is configured to adjust power supply to the motor 3 to thereby control a rotation speed of the rotation shaft 31. As the rotation speed control, the control circuit 71 is configured to: control a time period from a time when the motor 3 starts to be driven to a time when the rotation speed of the motor 3 reaches a prescribed target rotation speed; and perform a constant speed control after reaching the prescribed target rotation speed. In the constant speed control, the control circuit 71 controls the rotation speed of the motor 3 so that the rotation speed can be maintained at the prescribed target rotation speed. Note that the controlling of the rotation speed is performed by outputting, as PWM drive signals, drive signals for driving (switching on) predetermined three FETs of the switching circuit 22A (PWM control). Further, the control circuit 71 controls the start/stop of the motor 3 based on the start-up signal outputted from the switching mechanism 12A.

Further, as the main body control, the control circuit 71 is configured to: detect whether or not the dust collector 100 is connected to the main body 2 (hereinafter, referred to as "connection detection"); and control activation/non-activation (i.e., light-on/light-off) of the light part 8 based on a result of the connection detection. Details of the connection detection will be described later. Further, the control circuit 71 is configured to stop driving the motor 3 when the acceleration sensor 23 detects that the acceleration of the main body 2 exceeds a predetermined acceleration threshold value while the motor 3 is being driven.

Further, the control circuit 71 is configured to control driving of the collector motor 112 in the state where the dust collector 100 is connected to the main body 2. The control over the collector motor 112 is performed by outputting a dust-collector drive signal to the second signal line 27 to output the dust-collector drive signal to the dust collector 100 connected to the main body 2 through the main-body-side signal terminal 91C and collector-side signal terminal 116C. The dust-collector drive signal is an example of a "control signal" of the present invention.

Next, the electrical configuration of the dust collector 100 will be described. As illustrated in FIG. 6, the dust collector 100 includes an FET 140 and a dust-collector-side voltage dividing resistor 141, in addition to the above-described collector motor 112 and collector-side terminal portion 115.

The collector motor 112 is connected, through the FET 140, to the collector-side positive terminal 116A and collector-side negative terminal 116B of the collector-side terminal portion 115. That is, in the state where the dust collector 100 is connected to the main body 2, the collector motor 112 is connected to the positive line 24 and GND line 25 of the main body 2 through the FET 140. Thus, when the FET 140 is rendered ON (in a state where power supply to the collector motor 112 is allowed), the power of the battery 15 attached to the main body 2 is supplied to the collector motor 112, thereby driving the collector motor 112. On the other hand, when the FET 140 is rendered OFF (in a state where power supply to the collector motor 112 is shut off), the power of the battery 15 attached to the main body 2 is not supplied to the collector motor 112, thereby halting the collector motor 112. The FET 140 is an example of "switching means" in the present invention. The ON-state of the FET 140 is an example of a "first state", and the OFF state thereof is an example of a "second state" in the present invention.

The dust-collector-side voltage dividing resistor 141 is connected between the gate and the source of the FET 140. A connecting point 142 through which the dust-collector-side voltage dividing resistor 141 and the gate of the FET 140 are connected to each other is connected to the collector-side signal terminal 116C. That is, in the state where the dust collector 100 is connected to the main body 2, the gate of the FET 140 is connected to the control circuit 71 through the main-body-side signal terminal 91C and collector-side signal terminal 116C. In the present embodiment, the FET 140 is rendered ON while the control circuit 71 is outputting the dust-collector drive signal to the gate of the FET 140 through the main-body-side signal terminal 91C and collector-side signal terminal 116C; and the FET 140 is rendered OFF while the control circuit 71 is not outputting the dust-collector drive signal. The dust-collector-side voltage dividing resistor 141 is an example of an "attachment-device-side resistor" in the present invention.

Here, the connection detection by the control circuit 71 will be described. The control circuit 71 performs the connection detection using a value of the voltage (connection determination voltage) that appears at the node 27B on the second signal line 27. More specifically, the control circuit 71 outputs the dust-collector drive signal to the second signal line 27 to determine whether the dust collector 100 is connected to the main body 2. The control circuit 71 determines that the dust collector 100 is not connected to the main body 2 when the voltage appearing at the node 27B while the dust-collector drive signal is being outputted is higher than a predetermined voltage threshold value, whereas the control circuit 71 determines that the dust collector 100 is connected to the main body 2 when the voltage appearing at the node 27B while the dust-collector drive signal is being outputted is lower than the predetermined voltage threshold value.

In the present embodiment, the dust-collector drive signal is a voltage signal of substantially 5 V. When the dust-collector drive signal (5 V) is outputted to the second signal line 27 in a state where the dust collector 100 is not connected to the main body 2, the voltage appearing at the node 27B (i.e., the connection determination voltage) is substantially 5 V. On the other hand, when the dust-collector drive signal (5 V) is outputted to the second signal line 27 in the state where the dust collector 100 is connected to the main body 2, the dust-collector drive signal is divided by the main-body-side voltage dividing resistor 27A and the dust-collector-side voltage dividing resistor 141. Here, the resistance ratio between the main-body-side voltage dividing resistor 27A and the dust-collector-side voltage dividing resistor 141 is set such that substantially 4 V appears at the node 27B as a divided voltage, i.e., as the connection determination voltage. Thus, a value between 5 V and 4 V (4.5 V in the present embodiment) is used as the predetermined voltage threshold value. Hence, the control circuit 71 determines that the dust collector 100 is not connected to the main body 2 when the voltage appearing at the node 27B while the dust-collector drive signal is being outputted is equal to or higher than 4.5 V, whereas the control circuit 71 determines that the dust collector 100 is connected to the main body 2 when the voltage appearing at the node 27B is lower than 4.5 V.

Next, the main body control performed by the control circuit 71 (control substrate part 7) will be described while referring to the flowchart of FIG. 7.

When the battery 15 is attached to the battery attachment portion 21, power is supplied to the control circuit 71, and the control circuit 71 starts executing the main body control. After starting the main body control, the control circuit 71 determines whether or not the starting operation (pulling operation) to the trigger switch 12 is performed (S101). Specifically, the control circuit 71 determines whether or not the trigger switch 12 is subjected to the starting operation based on presence/absence of the start-up signal from the switching mechanism 12A.

When determining that the trigger switch 12 is not subjected to the starting operation (S101:NO), the control circuit 71 performs the determination of S101 again. That is, the control circuit 71 waits until the starting operation to the trigger switch 12 is performed while repeating the determination of S101. On the other hand, when determining that the starting operation to the trigger switch 12 is performed (S101:YES), the control circuit 71 outputs the dust-collector drive signal for driving the dust collector 100 to the second signal line 27 (S102).

Then, the control circuit 71 detects the connection determination voltage appearing at the node 27B on the second signal line 27 (S103), and determines, based on the detected connection determination voltage, whether or not the dust collector 100 is connected to the main body 2 (S104). That is, the control circuit 71 performs the connection detection in S103 and S104. Specifically, the control circuit 71 determines that the dust collector 100 is not connected to the main body 2 when the connection determination voltage is equal to or higher than 4.5 V; and the control circuit 71 determines that the dust collector 100 is connected to the main body 2 when the connection determination voltage is lower than 4.5 V. The result of the connection detection in S103 and S104 is temporarily stored in the non-illustrated memory (RAM) of the control circuit 71 as connection detection information about the connection/non-connection of the dust collector 100.

When determining that the dust collector 100 is not connected to the main body 2 (S104: NO), the control circuit 71 stops outputting the dust-collector drive signal (S105). That is, the control circuit 71 once outputs the dust-collector drive signal for the connection detection. In the case where the dust collector 100 is not connected to the main body 2, since there is no need to continue outputting the dust-collector drive signal for driving the dust collector 100, the control circuit 71 stops outputting the dust-collector drive signal upon completion of the connection detection.

The control circuit 71 then sets the light part 8 to the light-on state (activated state) (S106). When the LED light of the light part 8 is turned on, the work spot at which the end bit 14 applies machining (near the tip end of the end bit 14) is illuminated by the LED light.

After illuminating the light part 8, the control circuit 71 starts driving the motor 3 (S108).

On the other hand, when determining in S104 that the dust collector 100 is connected to the main body 2 (S104:YES), the control circuit 71 determines whether or not one second has elapsed from a point of time when the starting operation to the trigger switch 12 was determined to be performed in S101 (since when "YES" determination is made in S101) (S107).

When determining that one second has not yet elapsed from the point of time when the starting operation to the trigger switch 12 was performed (S107:NO), the control circuit 71 performs the determination of S107 again. That is, the control circuit 71 repeats the determination of S107 until one second is determined to have elapsed from when the trigger switch 12 was subjected to the starting operation.

When determining that one second has elapsed since the execution of the starting operation to the trigger switch 12 (S107:YES), the control circuit 71 starts driving the motor 3 (S108). That is, in the case where the dust collector 100 is connected to the main body 2, the control circuit 71 is configured to delay the starting of the motor 3 by one second as compared to a case where the dust collector 100 is not connected to the main body 2. This will be referred to as "start delay processing". Once the driving of the motor 3 is started, the end bit 14 is driven. When the driven end bit 14 is made to abut against the work piece, working such as drilling can be applied to the work piece.

After starting to drive the motor 3 (S108), the control circuit 71 then determines whether or not the starting operation for the trigger switch 12 has been released (S109). The control circuit 71 makes the determination on whether the starting operation is released based on the presence/absence of the start-up signal from the switching mechanism 12A. Specifically, the control circuit 71 determines that the starting operation for the trigger switch 12 is released at a point of time when the output of the start-up signal from the switching mechanism 12A is stopped.

When determining that the starting operation for the trigger switch 12 has not been released (S109:NO), the control circuit 71 performs the determination of S109 again. That is, the control circuit 71 continues driving the motor 3 until the starting operation for the trigger switch 12 is released while repeating the determination of S109.

When the starting operation for the trigger switch 12 is determined to have been released (S109:YES), the control circuit 71 determines whether the dust collector 100 is connected to the main body 2 (S110). That is, the connection detection is performed in S110. Specifically, in the connection detection performed in S110, the control circuit 71 refers to the connection detection information obtained and stored in the non-illustrated memory (RAM) (not illustrated) in the determination of S104. That is, in S110, the control circuit 71 does not perform the same processing as S104 but determines whether or not the dust collector 100 is connected by utilizing the result of the connection detection that was already obtained in S104.

When the dust collector 100 is determined not to be connected to the main body 2 (S110: NO), the control circuit 71 stops driving the motor 3 (S111) and sets the LED light of the light part 8 to the turned-off state (non-active state) (S112). After turning off the LED light of the light part 8, the control circuit 71 waits for the operator to perform the starting operation for the trigger switch 12 while repeating the determination of S101.

On the other hand, when the dust collector 100 is connected to the main body 2 (S110: YES), the control circuit 71 stops driving the motor 3 in S113.

After stopping driving the motor 3, the control circuit 71 determines in S114 whether or not ten seconds has elapsed from a point of time when the driving of the motor 3 was stopped in S113. When determining that ten seconds has not elapsed from the point of time when the driving of the motor 3 was stopped (S114:NO), the control circuit 71 repeats the determination of S114 until ten seconds elapses.

When determining that ten seconds has elapsed from the point of time when the driving of the motor 3 was stopped (S114:YES), the control circuit 71 stops, in S115, outputting the dust-collector drive signal that has been outputted continuously since S102. When the output of the dust-collector drive signal is terminated, the FET 140 of the dust collector 100 is rendered OFF to stop the driving of the collector motor 112. The driving of the dust collector 100 is thus ended. That is, the control circuit 71 is configured to stop driving the collector motor 112 of the dust collector 100 after stopping driving the motor 3 of the main body 2. This processing will be referred to as "stop delay processing". After the collector motor 112 is halted, the control circuit 71 waits for the operator to perform the starting operation for the trigger switch 12 while repeating the determination of S101.

Figure 8:
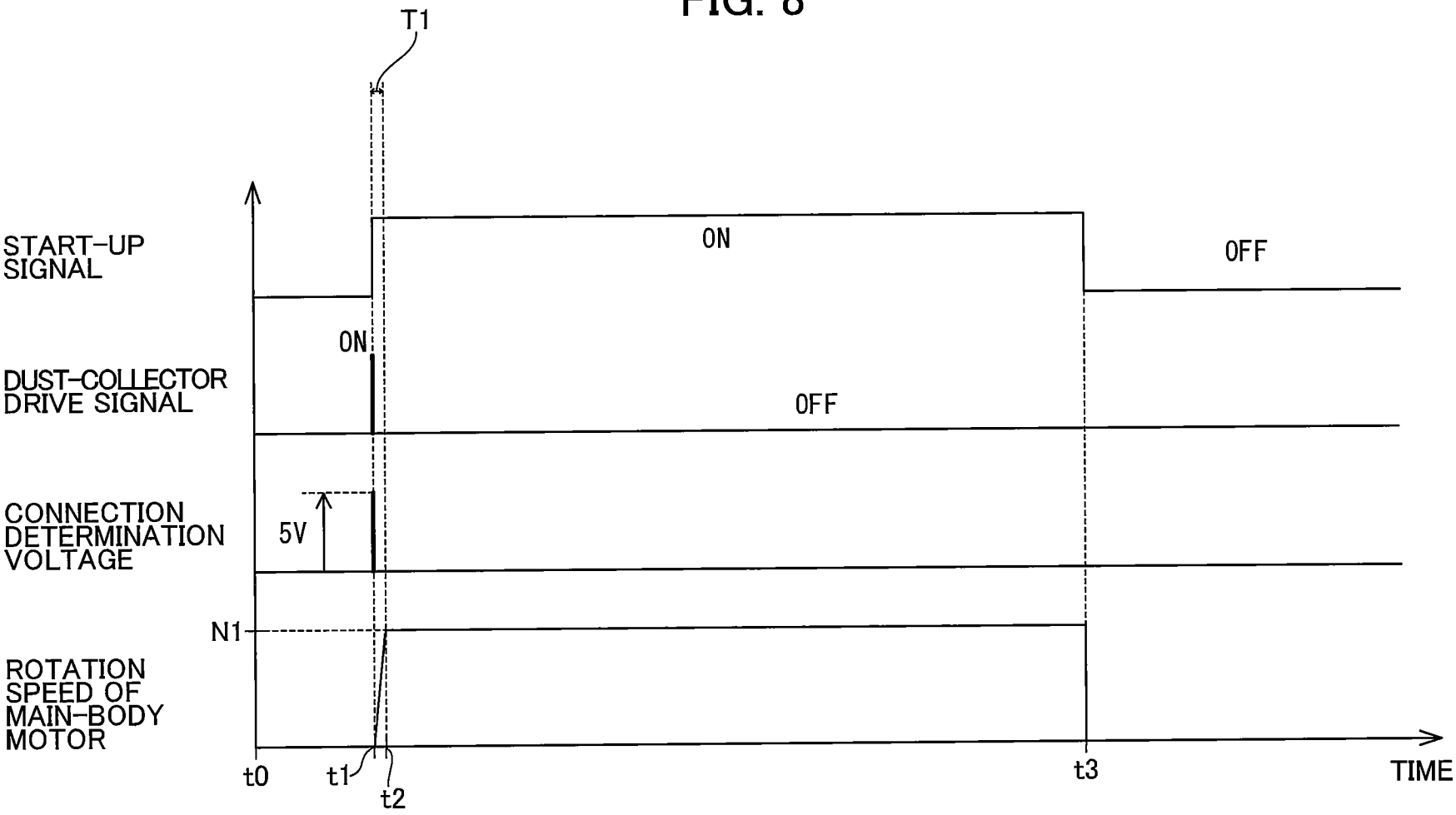
FIG. 8 is a timing chart illustrating a relationship among driving of a motor and various signals in the main body control according to the embodiment executed by the controller in a state where the dust collector is not connected.

Here, relationship between the driving of the motor 3 and various signals in the above-described main body control performed by the control circuit 71 will be described using the timing charts of FIGS. 8 and 9.

First, with reference to FIG. 8, a case where the dust collector 100 is not connected to the main body 2 will be described.

When the starting operation is performed to the trigger switch 12 at a timing t1, the motor 3 starts to be driven. Note that, at the timing t1, the control circuit 71 performs: output of the dust-collector drive signal; detection of the connection determination voltage (substantially 5 V); the connection detection based on the detected connection determination voltage; and halt of the output of the dust-collector drive signal. These correspond to the processing of: from S101: YES to S104:NO, S105, and S108 in the flowchart of FIG. 7. Further, at the timing t1, the LED light of the light part 8 is turned on (corresponding to the processing of S106 in the flowchart of FIG. 7).

In this timing chart, in order to facilitate description, the output of the dust-collector drive signal, the detection of the connection determination voltage, the connection detection, the halt of the output of the dust-collector drive signal, the lighting-on of the light part 8, and the driving of the motor 3 are all assumed to be performed at the timing t1. Actually, however, the output of the dust-collector drive signal, the detection of the connection determination voltage, the connection detection, the halt of the output of the dust-collector drive signal, the lighting-on of the light part 8, and the driving of the motor 3 are performed sequentially in this order in a very short period of time.

Once the driving of the motor 3 is started at the timing t1, the rotation speed of the motor 3 reaches a prescribed target rotation speed N1 at a timing t2 after a lapse of a time period T1 from the timing t1.

Thus, in the case where the dust collector 100 is not connected to the main body 2, the control circuit 71 controls the driving of the motor 3 such that the rotation speed of the motor 3 reaches the prescribed target rotation speed N1 after the time period T1 has elapsed from when the starting operation is performed for the trigger switch 12. In other words, a time period required for the rotation speed of the motor 3 to reach the prescribed target rotation speed N1 from when the starting operation is performed for the trigger switch 12 (hereinafter, referred to as "arrival required time period") is the time period T1.

After the rotation speed reaches the prescribed target rotation speed N1 at the timing t2, the control circuit 71 continues driving the motor 3 with the rotation speed thereof maintained at the target rotation speed N1 under constant rotation speed control. Thereafter, when the starting operation for the trigger switch 12 is released at a timing t3, the driving of the motor 3 is halted at this point of time. This corresponds to the processing of S109:YES, S110:NO, and S111 in the flowchart of FIG. 7. Further, at the timing t3 when the starting operation for the trigger switch 12 is released, the LED light of the light part 8 is also turned off (corresponding to processing of S112 in the flowchart of FIG. 7).

Figure 9:
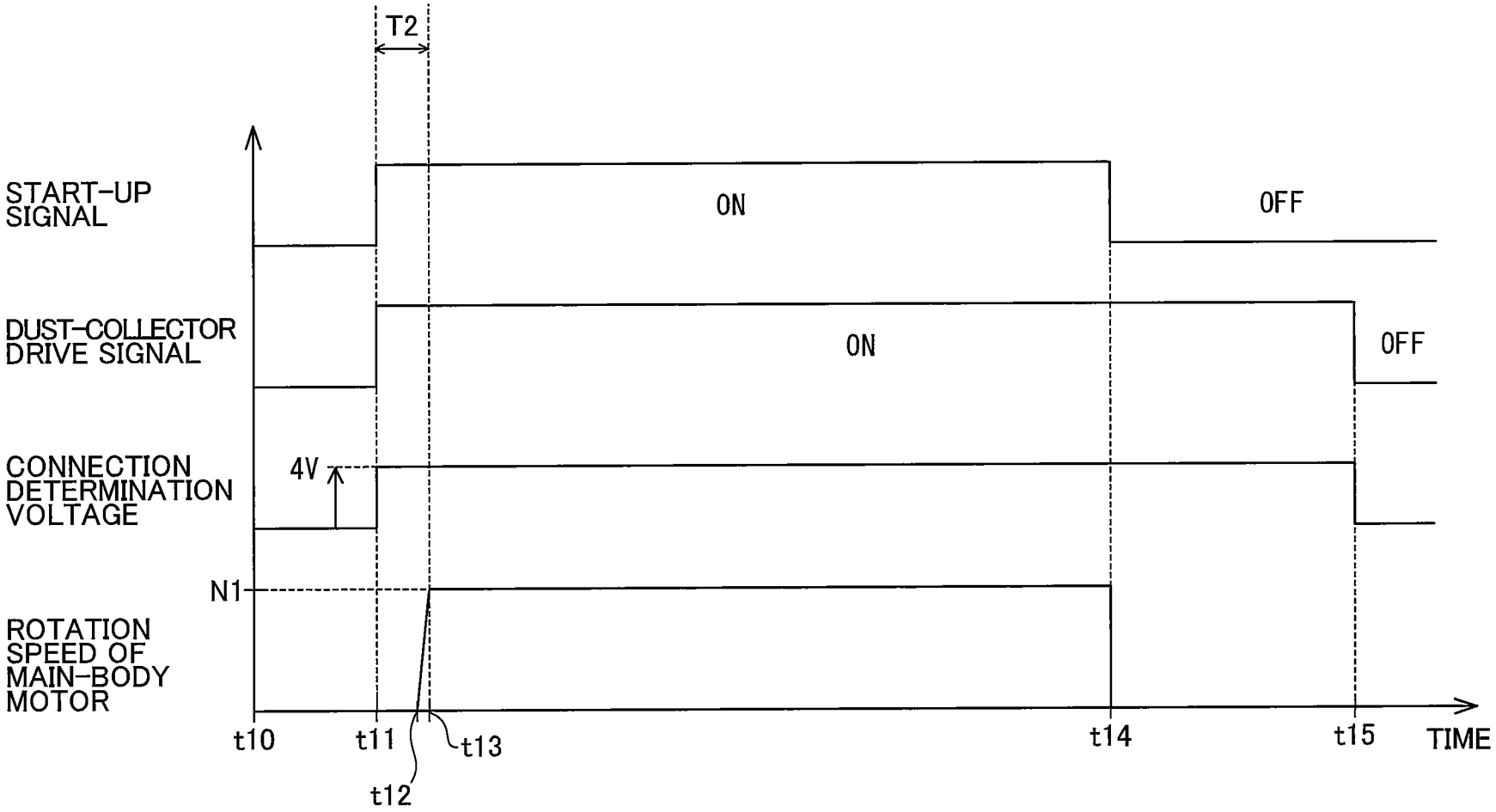
FIG. 9 is a timing chart illustrating a relationship among driving of the motor and various signals in the main body control according to the embodiment executed by the controller in the state where the dust collector is connected.

On the other hand, referring to FIG. 9, in a case where the dust collector 100 is connected to the main body 2, when the starting operation is performed for the trigger switch 12 at a timing t11, the control circuit 71 outputs the dust-collector drive signal, and a voltage of substantially 4 V is detected as the connection determination voltage. This corresponds to the processing from S101:YES to S103 in the flowchart of FIG. 7.

Because the dust collector 100 is connected to the main body 2, the driving of the motor 3 is started at a timing t12 after a lapse of one second from the timing t11. This corresponds to the processing of S104:YES, S107, and S108 in the flowchart of FIG. 7. When the motor 3 starts to be driven, the rotation speed of the motor 3 reaches the prescribed target rotation speed N1 at a timing t13 after a lapse of a time period T2 from the timing t11.

In this way, in the case where the dust collector 100 is connected to the main body 2, the control circuit 71 controls the driving of the motor 3 such that the rotation speed of the motor 3 reaches the prescribed target rotation speed N1 after the lapse of the time period T2 from when the starting operation is performed for the trigger switch 12. In other words, the arrival required time period when the dust collector 100 is connected to the main body 2 is the time period T2.

Note that, in the present embodiment, a required time period from when the motor 3 is started until when the rotation speed of the motor 3 reaches the prescribed target rotation speed N1 is constant regardless of whether the dust collector 100 is connected or disconnected relative to the main body 2. That is, the required time period in FIG. 8 (time period between the timing t1 and timing t2) and the required time period in FIG. 9 (time period between the timing t12 and timing t13) are identical to each other. However, the arrival required time period differs depending on whether the dust collector 100 is connected or disconnected relative to the main body 2. This is because the start delay processing (S107) is performed when the dust collector 100 is connected to the main body 2, while the start delay processing is not performed when the dust collector 100 is not connected. That is, the time period T2 (i.e., the arrival required time period with execution of the start delay processing when the dust collector 100 is connected) is longer than the time period T1 (i.e., the arrival required time period when the dust collector 100 is not connected). The time period T1 is an example of a "first time period" in the present invention, and the time period T2 is an example of a "second time period" in the present invention.

That is, in the main body control according to the present embodiment, there is no difference in the control to be performed after the motor 3 starts to be driven between the two cases; however, focusing on the point of time when the starting operation for the trigger switch 12 is performed, the rotation speed of the motor 3 is so configured to reach the target rotation speed N1 at a later timing when the dust collector 100 is connected than when the dust collector 100 is not connected.

After the rotation speed of the motor 3 reaches the prescribed target rotation speed N1 at the timing t13, the control circuit 71 continues to drive the motor 3 with the rotation speed thereof maintained at the target rotation speed N1 under the constant rotation speed control. When the starting operation for the trigger switch 12 is released thereafter at a timing t14, the driving of the motor 3 is halted. This corresponds to the processing of S109:YES, S110: YES, and S113 in the flowchart of FIG. 7.

Figure 7:
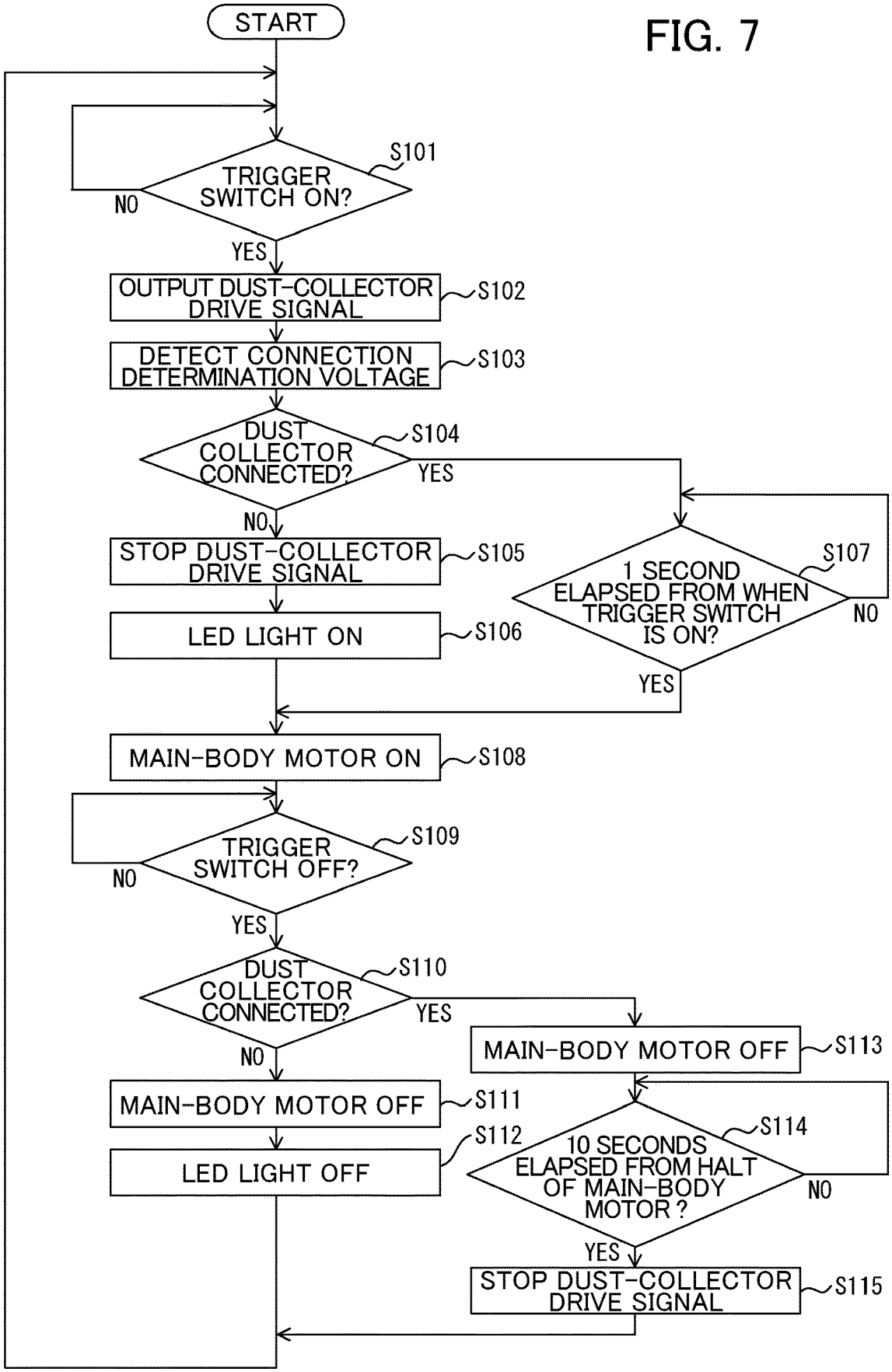
FIG. 7 is a flowchart explaining a main body control according to the embodiment of the present invention that is executed by a controller.

Even after the driving of the motor 3 is stopped at the timing t14, the dust-collector drive signal is kept being outputted for a period of ten seconds (corresponding to the processing of S114:NO in FIG. 7). That is, the output of the dust-collector drive signal is halted at a timing t15 after a lapse of 10 seconds from the timing t14. This corresponds to the stop delay processing from S114:YES to S115 in the flowchart of FIG. 7. Note that, in response to the halt of the output of the dust-collector drive signal, the output of the connection determination voltage from the node 27B to the control circuit 71 is also halted at the timing t15.

As described above, in the main body control according to the present embodiment, the control circuit 71 is configured to detect whether or not the dust collector 100 is connected to the main body 2 by referring to the connection determination voltage, and to change the control for the main body 2 depending on whether or not the dust collector 100 is connected. That is, the control over the main body 2 can be changed appropriately between the case where the dust collector 100 is connected to the main body 2 and the case where the dust collector 100 is disconnected from the main body 2. Thus, the operations of the hammer drill 1 can be controlled appropriately according to the connection status thereof to the dust collector 100: whether the hammer drill 1 is used alone or where the hammer drill 1 is used with the dust collector 100 connected to the main body 2. Hence, improved working efficiency can be realized.

In general, attachment devices are often developed so as to be light-weighted, inexpensive, and versatile. Hence, there are limited variations available as specifications for each attachment device, and designing attachment devices suitable for each working tool is difficult to realize. However, according to the main body control of the present embodiment, the main body control is performed by the control circuit 71 of the main body 2 to which the dust collector 100 is connectable so that the main body control can be made variant appropriately depending on whether or not the dust collector 100 is connected to the main body 2. This configuration can improve working efficiency of the hammer drill 1 with the dust collector 100 connected thereto, while maintaining versatility in structure of the dust collector 100 as the attachment device.

Further, in the present embodiment, the control circuit 71 is configured to control whether the light part 8 as the assisting means should be set to the active state or the non-active state in a work initiated by the starting operation to the trigger switch 12 based on the connection status of the dust collector 100 relative to the main body 2. That is, whether to activate the light part 8 or not can be appropriately determined depending on whether the hammer drill 1 is used alone or used with the dust collector 100 connected to the main body 2. Thus, this configuration can provide suitable control over the operation state of the light part 8 during the work depending on whether or not the connection of the dust collector 100 is established, thereby leading to improvement of working efficiency.

Specifically, in the present embodiment, the control circuit 71 places the light part 8 into the light-on state (active state) during the work when the dust collector 100 is not connected to the main body 2, while placing the light part 8 into the light-off state (non-active state) during the work when the dust collector 100 is connected to the main body 2.

In a configuration where the dust collector 100 connected to the main body 2 is positioned between the tip end of the end bit 14 (as the work part) and the light part 8 as in the present embodiment, when the LED light is emitted from the light part 8 while the dust collector 100 is connected to the main body 2, the emitted LED light may be blocked by the connected dust collector 100 or the emitted LED light may be reflected in an unintended direction, which may hinder the work. In order to cope with this problem, the light part 8 (lighting means) is set to the light-off state (non-active state) when the dust collector 100 is connected in the present embodiment, because the activation of the light part 8 may result in deterioration in working efficiency. This configuration can prevent occurrence of any inconvenience attributed to the LED light. Further, power consumption can be reduced, because the light part 8 is placed in the light-off state.

Further, when the hammer drill 1 is used alone, the light part 8 is configured to be illuminated. Hence, operator's visibility in working can be ensured.

Further, in the present embodiment, the control circuit 71 can change the drive control over the motor 3 depending on availability of the connection of the dust collector 100 relative to the main body 2. That is, the control circuit 71 can provide the drive control for the motor 3 as appropriate in a different manner between the case where the dust collector 100 is connected to the main body 2 and the case where the dust collector 100 is not connected to the main body 2.

As a result, the configuration of the embodiment can provide the drive control over the motor 3 suitably for each of the case where the hammer drill 1 is used alone and the case where the hammer drill 1 is used with the dust collector 100 connected to the main body 2. Accordingly, the dust collector 100 and main body 2 can be operated in good cooperation with each other in the state where the dust collector 100 is connected to the main body 2, leading to improvement in working efficiency.

The "main body control" of the present invention is a concept that includes not only the drive control for the motor 3 by the control circuit 71 (control substrate part 7), but also the control over the assisting means as described above.

Further, in the main body control according to the present embodiment, the control circuit 71 controls the rotation speed of the motor 3 to reach the target rotation speed N1 after the lapse of the time period T1 from when the starting operation is performed for the trigger switch 12 when the dust collector 100 is not connected to the main body 2, while the control circuit 71 controls the rotation speed of the motor 3 to reach the target rotation speed N1 after the lapse of the time period T2 longer than the time period T1 from when the starting operation is performed for the trigger switch 12 when the dust collector 100 is connected to the main body 2.

In a case where a dust collector as the attachment device is connected to a main body of a work tool, usually a certain time lag is generated between a timing when the dust collector is connected and a timing when a negative pressure is generated within the dust collector. Thus, if the motor is controlled in the same way as each other regardless of whether the dust collector is connected or disconnected, conceivably, the motor may be driven to initiate machining before a sufficient sucking force is generated in the dust collector. However, in the present embodiment, the time period T2 required for the rotation speed of the motor 3 to reach the target rotation speed N1 after the starting operation is performed for the trigger switch 12 when the dust collector 100 is connected is set longer than the time period T1 required when the dust collector 100 is not connected. That is, referring to the point of time when the starting operation is performed for the trigger switch 12, the rotation speed of the motor 3 reaches the target rotation speed N1 later when the dust collector 100 is connected than when the dust collector 100 is not connected. With this configuration, the timing at which the connected dust collector 100 is driven to generate a sufficient negative pressure can be brought closer to the timing at which the rotation speed of the motor 3 reaches the target rotation speed N1. Thus, the motor 3 of the main body 2 can be suppressed from starting to be driven before the dust collector 100 is driven sufficiently.

Further, in the main body control according to the present embodiment, when the starting operation for the trigger switch 12 is released, the dust collector 100 is caused to stop after the motor 3 is halted (stop delay processing).

Normally, the end bit 14 supported by the end-bit mount portion 10 driven by the motor 3 is kept being driven for a while by inertia even after the driving of the motor 3 is stopped. In the present embodiment, the dust collector 100 is stopped after the driving of the motor 3 of the main body 2 is stopped (after the lapse of 10 seconds from the time when the driving of the motor 3 is halted in the present embodiment). Accordingly, dust or the like generated as a result of the driving of the end bit 14 until the end bit 14 completely stops after the motor 3 is stopped can be reliably collected by the dust collector 100.

In a configuration where the motor 3 and the collector motor 112 of the dust collector 100 are configured to be stopped substantially at the same time, conceivably, the dust collector 100 may be caused to stop before the sucked dust and the like is collected in the dust-collection case 113, with the dust left in the space 121*a* of the hose 121 or in the space 130*a* of the adaptor portion 130. In contrast, because the dust collector 100 is configured to be stopped after the motor 3 of the main body 2 is halted in the present embodiment, the dust remaining in the dust collector 100 can be reliably collected in the dust-collection case 113.

Further, the hammer drill 1 according to the present embodiment includes the acceleration sensor 23 for detecting the acceleration of the main body 2. The control circuit 71 is configured to stop driving the motor 3 when the acceleration detected by the acceleration sensor 23 exceeds the predetermined acceleration threshold value.

With this configuration, the motor 3 is forced to stop driving when the acceleration of the main body 2 exceeds the predetermined acceleration threshold value, for example, due to stall of the end bit 14 driven by the motor 3 during a work. An excessive load is thus less likely to be imparted on the main body 2.

Further, in the present embodiment, the dust collector 100 includes the collector motor 112 and the FET 140. The collector motor 112 is configured to be driven in response to receipt of power supply from the main body 2 connected thereto. The FET 140 is switchable between an ON state where power supply to the collector motor 112 is allowed and an OFF state where power supply to the collector motor 112 is shut off. The main body 2 includes the second signal line 27 connected to the FET 140 in the state where the main body 2 is connected to the dust collector 100. The control circuit 71 is configured to: output, to the FET 140, the dust-collector drive signal for rendering the FET 140 ON through the second signal line 27; and perform the connection detection to detect whether the dust collector 100 is connected to the main body 2 using the second signal line 27.

That is, the second signal line 27 that is used to output the dust-collector drive signal for switching between the ON and OFF states of the FET 140 can also be used to perform the connection detection for detecting the connection status of the dust collector 100. This configuration can eliminate the need to provide another signal line for the connection detection in addition to the second signal line 27. This configuration can therefore reduce the number of components required to manufacture the hammer drill 1, thereby leading to lower manufacturing costs and improvement of assembly performance.

Further, the dust collector 100 further includes the dust-collector-side voltage dividing resistor 141 connected to the second signal line 27 in the state where the dust collector 100 is connected to the main body 2. The second signal line 27 of the main body 2 includes the main-body-side voltage dividing resistor 27A having one end connected to the control circuit 71 and another end connected to the dust-collector-side voltage dividing resistor 141 in the state where the dust collector 100 is connected to the main body 2. The control circuit 71 is configured to perform the connection detection for detecting the connection status of the dust collector 100 relative to the main body 2 based on the value of the divided voltage divided by the dust-collector-side voltage dividing resistor 141 and the main-body-side voltage dividing resistor 27A (i.e., based on the voltage appearing at the node 27B).

With this configuration, the connection/non-connection of the dust collector 100 relative to the main body 2 can be detected with a simple circuit configuration. Further reduction in manufacturing costs and further improvement of assembly performance can be obtained.

Further, in the present embodiment, as the attachment device, the dust collector 100 can be attached to and detached from the main body 2 for generating the negative pressure at the work spot at which the end bit 14 applies machining.

Thus, the dust or the like generated as a result of the machining performed by the end bit 14 can be sucked and collected by utilizing the negative pressure of the connected dust collector 100 as the attachment device. Improved working efficiency can be obtained. In particular, just as the hammer drill 1 of the present embodiment, in a case where the work tool is a drilling tool that may generate a large amount of dust by the working of the end bit 14, connecting the dust collector 100, as the attachment device, to the main body 2 can obtain further improved working efficiency because the connected dust collector 100 can suck and collect the generated dust.

While the main body control according to the present embodiment has been described, the main body control according to the present invention is not limited to the described one. Hereinafter, a main body control according to a first modification to the depicted embodiment will be described with reference to a flowchart of FIG. 10.

The main body control according to the first modification differs from the main body control of the above embodiment in processing to be performed during a period from when the starting operation for the trigger switch 12 is performed until when the motor 3 starts to be driven.

Specifically, upon starting the main body control, the control circuit 71 determines whether or not the starting operation has been performed for the trigger switch 12 (S201). When determining that the starting operation has been performed for the trigger switch 12 (S201:YES), the control circuit 71 outputs the dust-collector drive signal to the second signal line 27 (S202) and detects the connection determination voltage (S203). Then, the control circuit 71 performs the connection detection to determine whether or not the dust collector 100 is connected to the main body 2 based on the connection determination voltage detected in S203 (S204). The above processing from S201 to S204 is the same as the processing from S101 to S104 of the flowchart of FIG. 7 in the main body control according to the above embodiment.

When determining in S204 that the dust collector 100 is not connected to the main body 2 (S204:NO), the control circuit 71 stops outputting the dust-collector drive signal (S205).

Then, in S206, the control circuit 71 sets a time period from a time when the motor 3 starts to be driven to a time when the rotation speed of the motor 3 reaches the prescribed target rotation speed N1 (target-rotation-speed arrival time period) to 0.2 seconds. That is, the control circuit 71 performs the drive control of the motor 3 such that the rotation speed of the motor 3 reaches the prescribed target rotation speed N1 in 0.2 seconds after the motor 3 is started to drive.

Subsequently, the control circuit 71 sets the light part 8 to the light-on state (S207) and starts driving the motor 3 (S209). In the main body control according to the first modification, the processing of S210:YES and from S211:NO to S213 to be performed after the motor 3 is started in S209 when the dust collector 100 is not connected to the main body 2 is the same as the processing of S109:YES and from S110:NO to S112 of the flowchart of FIG. 7 in the main body control according to the above embodiment.

On the other hand, when determining in S204 that the dust collector 100 is connected to the main body 2 (S204:YES), the control circuit 71 sets the target-rotation-speed arrival time period of the motor 3 to one second (S208). That is, the control circuit 71 performs the drive control of the motor 3 such that the rotation speed of the motor 3 reaches the prescribed target rotation speed N1 in one second after the motor 3 is started to drive.

After setting the target-rotation-speed arrival time period to one second in S208, the control circuit 71 starts driving the motor 3 (S209). In the main body control according to the first modification, the processing of S210:YES and from S211:YES to S216 to be performed after the motor 3 is started in S209 when the dust collector 100 is connected to the main body 2 is the same as the processing of S109:YES and from S110:YES to S115 of the flowchart of FIG. 7 in the main body control according to the above embodiment.

Figure 11:
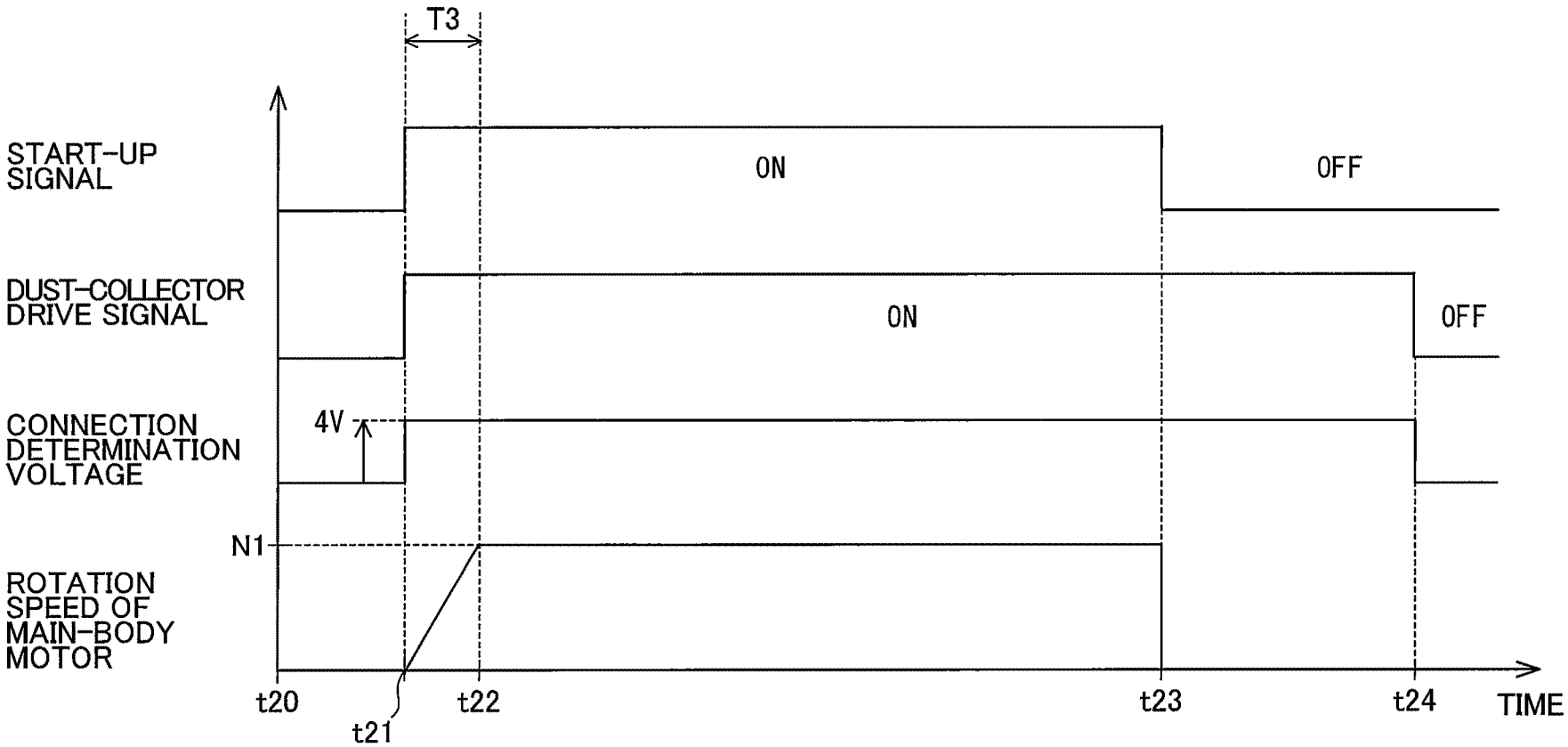
FIG. 11 is a timing chart illustrating a relationship among driving of the motor and various signals in the main body control according to the first modification to the embodiment executed by the controller in the state where the dust collector is connected.

Next, a relationship between the driving of the motor 3 and various signals in the case where the dust collector 100 is connected to the main body 2 in the above-described main body control performed by the control circuit 71 will be described with reference to a timing chart of FIG. 11.

When the starting operation is performed for the trigger switch 12 at a timing t21, the motor 3 is started to drive. At the timing t21, the control circuit 71 performs: output of the dust-collector drive signal; detection of the connection determination voltage (substantially 4 V), the connection detection based on the detected connection determination voltage; and setting of the target-rotation-speed arrival time period (one second) of the motor 3. This corresponds to the processing from S201:YES to S204:YES, S208, and S209 in the flowchart of FIG. 10. At this time, because the dust collector 100 is connected, the LED light of the light part 8 is kept turned off.

For facilitating description, in this timing chart as well, the following are all assumed to be performed at the timing t21: the output of the dust-collector drive signal; the detection of the connection determination voltage; the connection detection; the setting of the target-rotation-speed arrival time period; and the start of the motor 3. Actually, however, the output of the dust-collector drive signal, the detection of the connection determination voltage, the connection detection, the setting of the target-rotation-speed arrival time period, and the start of the motor 3 are performed sequentially in this order in a very short period of time.

Figure 10:
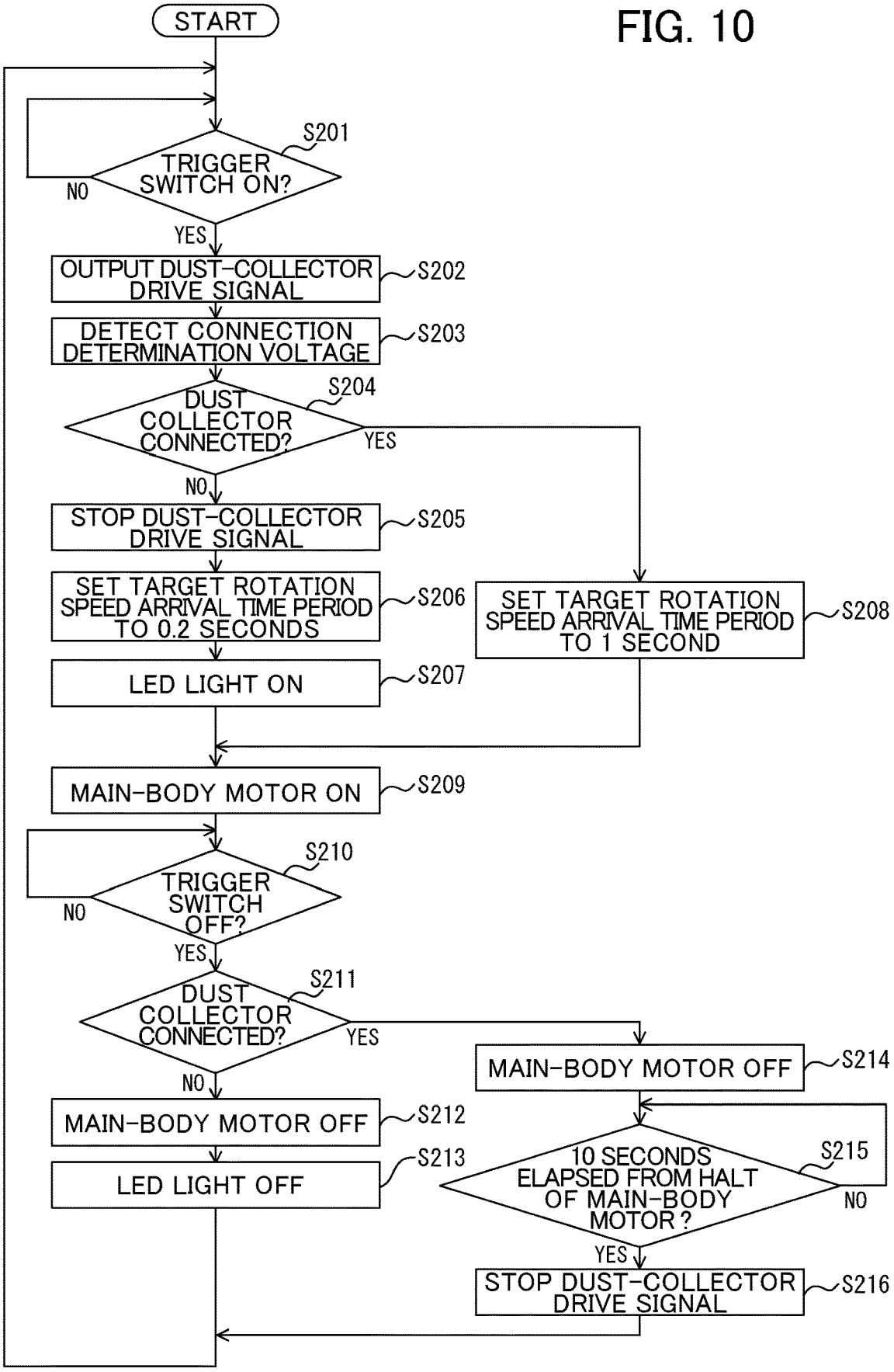
FIG. 10 is a flowchart explaining a main body control according to a first modification to the embodiment of the present invention that is executed by the controller.

In the main body control according to the first modification, the rotation speed of the motor 3 reaches the target rotation speed N1 at a timing t22 after a lapse of one second from the timing t21 based on the target-rotation-speed arrival time period set in S208 of FIG. 10. That is, in the main body control according to the first modification, the arrival required time period (time period from the time when the starting operation is performed for the trigger switch 12 to the time when the rotation speed of the motor 3 reaches the target rotation speed N1) when the dust collector 100 is connected to the main body 2 is a time period T3 (a time period between the timing t21 and timing t22).

In the main body control according to the first modification, in the case where the dust collector 100 is not connected to the main body 2, the target-rotation-speed arrival time period of the motor 3 is set to 0.2 seconds (S206 in FIG. 10). Hence, the time period T3 which is the arrival required time period when the dust collector 100 is connected is longer than the arrival required time period when the dust collector 100 is not connected. That is, also in the main body control according to the first modification, the rotation speed of the motor 3 is configured to reach the target rotation speed N1 at a later timing when the dust collector 100 is connected than when the dust collector 100 is not connected. In the first modification, the arrival required time period when the dust collector 100 is not connected is an example of the "first time period" in the present invention, and the time period T3 is an example of the "second time period" in the present invention.

After the rotation speed reaches the prescribed target rotation speed N1 at the timing t22, the control circuit 71 continues driving the motor 3 with the rotation speed thereof maintained at the target rotation speed N1 through the constant rotation speed control.

When the starting operation for the trigger switch 12 is released thereafter at a timing t23, the driving of the motor 3 is halted. This corresponds to the processing of S210:YES, S211:YES, and S214 in the flowchart of FIG. 10.

Even after the driving of the motor 3 is halted at the timing t23, the dust-collector drive signal is kept being outputted for 10 seconds (corresponding to the stop delay processing of S215:NO in the flowchart of FIG. 10). Subsequently, the output of the dust-collector drive signal is halted at a timing t24 after a lapse of 10 seconds from the timing t23 when the driving of the motor 3 was stopped. This corresponds to the processing from S215: YES to S216 in the flowchart of FIG. 10. In response to the halt of the output of the dust-collector drive signal, the output of the connection determination voltage from the node 27B is also halted at the timing t24.

As described above, in the main body control according to the first modification as well, the time period T3 which is the arrival required time period from the time when the starting operation is performed for the trigger switch 12 to the time when the rotation speed of the motor 3 reaches the target rotation speed N1 when the dust collector 100 is connected is set longer than the arrival required time period when the dust collector 100 is not connected. With this structure, the timing at which the connected dust collector 100 is sufficiently driven can be brought closer to the timing at which the rotation speed of the motor 3 reaches the target rotation speed N1. Thus, the driving of the motor 3 is less likely to be started before the dust collector 100 is sufficiently driven.

In addition, the same technical advantages as the main body control according to the above embodiment can be obtained.

The work tool according to the present invention is not limited to the embodiment described above, but many modifications and variations may be made therein without departing from the scope of the appended claims.

For example, in each of the main body control according to the above embodiment and the first modification, a maximum rotation speed of the motor 3 is set to the same value, i.e., the target rotation speed N1, for both of the cases where the dust collector 100 is connected and the dust collector 100 is not connected. However, the maximum rotation speed of the motor 3 may be made different between the case where the dust collector 100 is connected and the case where the dust collector 100 is not connected.

Figure 12:
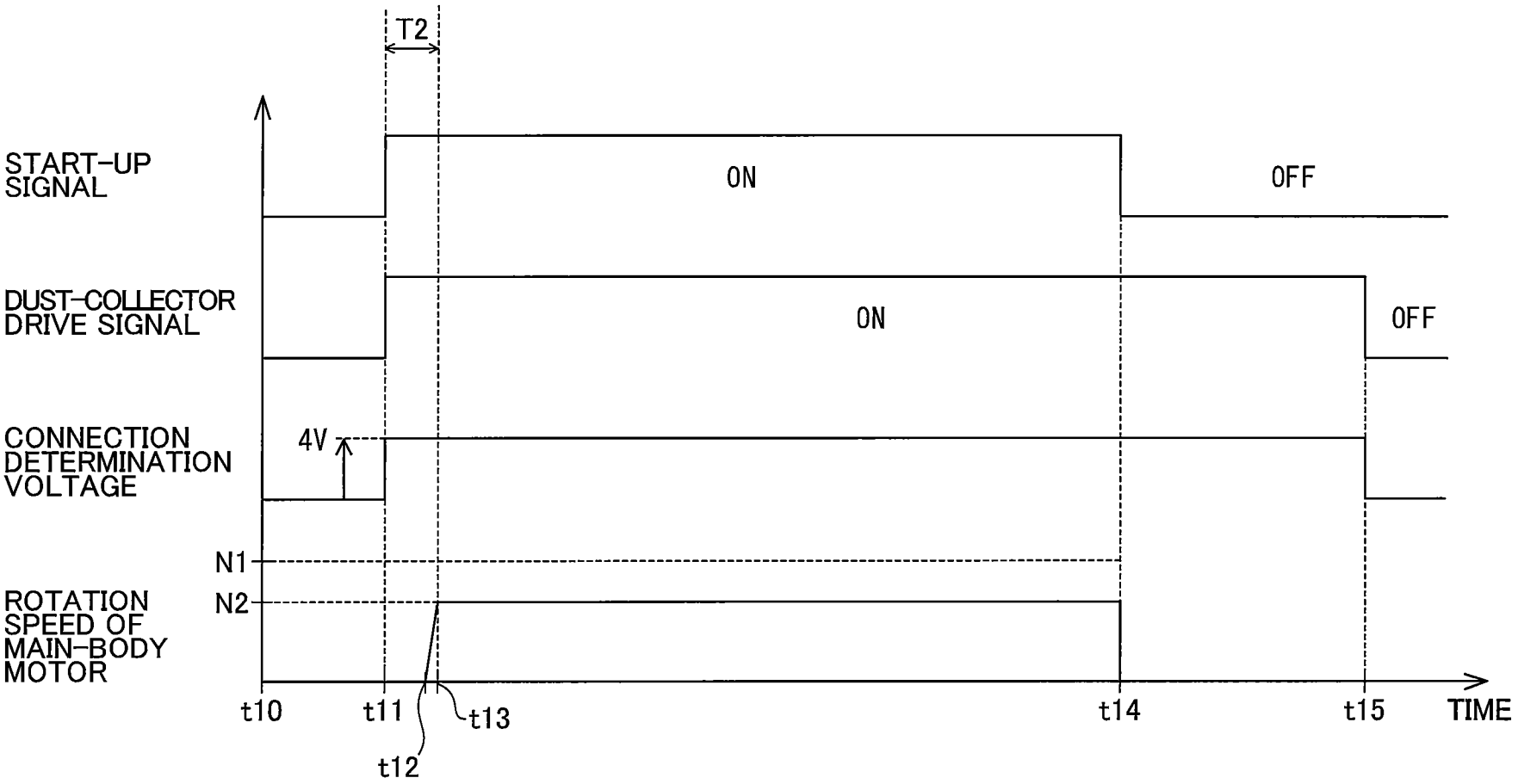
FIG. 12 is a timing chart illustrating a relationship among driving of the motor and various signals in the main body control according to a second modification to the embodiment executed by the controller in the state where the dust collector is connected.

FIG. 12 is a timing chart illustrating a relationship between a control performed by the control circuit 71 and the driving of the motor 3 when the dust collector 100 is connected to the main body 2 in the main body control according to a second modification to the embodiment.

As illustrated in FIG. 12, in the main body control according to the second modification, the maximum rotation speed of the motor 3 when the dust collector 100 is connected is set to a target rotation speed N2 lower than the target rotation speed N1. That is, the maximum rotation speed of the motor 3 when the dust collector 100 is connected may be set lower than the maximum rotation speed of the motor 3 when the dust collector 100 is not connected. The target rotation speed N1 according to the second modification is an example of a "first rotation speed" in the present invention, and the target rotation speed N2 is an example of a "second rotation speed" in the present invention.

With this configuration, the amount of dust or the like generated by a work performed by the end bit 14 can be reduced. This configuration is particularly effective in a case where a large amount of dust is likely to be generated during a work; or in a configuration where the dust collector 100 as the attachment device is connected to the main body 2. In other words, even when dust collecting performance of the dust collector 100 is kept constant, dust collection efficiency can be increased by the reduction in the amount of the generated dust.

FIG. 12 illustrates a case where the main body control according to the second modification is combined with the main body control of the above embodiment. Note that the main body control according to the second modification may also be combined with the main body control according to the first modification.

In the above embodiment and the first modification, the target rotation speed is one predetermined value, but need not to be limited thereto. For example, there may be provided a dial for changing the target rotation speed. In this case, a prescribed target rotation speed can be set according to an operation amount (position) of the dial. Still further, the target rotation speed corresponding to the operation amount of the dial may be made different depending on whether the dust collector 100 is connected or not. For example, a target rotation speed corresponding to a predetermined dial operation amount when the dust collector 100 is connected may be set lower than a target rotation speed corresponding to a predetermined operation amount when the dust collector 100 is not connected. In this case, the maximum rotation speed of the motor 3 when the dust collector is connected can be lower than the maximum rotation speed of the motor 3 when the dust collector 100 is not connected. Accordingly, the similar technical advantages as the above second modification can be obtained.

Alternatively, for example, in the case where the dust collector 100 is not connected, the target rotation speed may be made proportional to the dial operation amount such that the target rotation speed becomes maximum when the dial operation amount is maximum; however, when the dust collector 100 is connected, the target rotation speed may not be increased proportionally but made constant in a case where the dial operation amount is equal to or larger than a predetermined amount. In this case, as long as the dial operation amount is equal to or larger than the predetermined amount, the maximum rotation speed of the motor 3 when the dust collector 100 is connected can be made lower than the maximum rotation speed of the motor 3 when the dust collector 100 is not connected. Accordingly, the similar technical advantages as the above second modification can be obtained.

Further, the switching mechanism 12A of the above embodiment is configured to output the start-up signal of a fixed value to the control circuit 71 (control substrate part 7) irrespective of an amount by which the trigger switch 12 is pulled in the starting operation. However, the present invention is not limited to this configuration. For example, the start-up signal of a value corresponding to the amount by which the trigger switch 12 is puled may be outputted to the control circuit 71. In this case, the control circuit 71 may set a target rotation speed according to the value of the start-up signal.

Further, in the above embodiment, the light part 8 as the assisting means is configured to be placed in the light-off state (non-active state) when the dust collector 100 is connected, while placed in the light-on state (active state) when the dust collector 100 is not connected. In addition to the lighting means like the light part 8, a display that can display information on the main body 2 may be available as the assisting means that is deactivated when the attachment device is connected but activated when the attachment device is not connected.

Further, contrary to the depicted embodiment, the assisting means may be activated when the attachment device is connected, but may be deactivated when the attachment device is not connected. As the assisting means as such, an indication lamp or a display may be provided in the main body of the work tool in order to allow an operator to be notified of an operating state of the attachment device and/or necessity of maintenance (for example, if the attachment device is a dust collector, such information that a dust-collection case is full, or whether a filter should be replaced or not).

Further, in the above embodiment, the light part 8 as the assisting means is put in the light-off state (non-active state) when the dust collector 100 is connected, while being put in the light-on state (active state) when the dust collector 100 is not connected; that is, power to be supplied to the assisting means is rendered ON/OFF depending on whether the connection/non-connection of the dust collector 100. However, the present invention is not limited to this. For example, power to be supplied to the assisting means may be changed depending on the connection/non-connection of the dust collector 100.

Further, in the above embodiment, the light part 8 (lighting means) is provided only at the main body 2 and is configured to be put in the light-off state (non-active state) when the dust collector 100 is connected. However, the lighting means may be provided not only at the main body 2 but also at the dust collector 100 connectable to the main body 2. In this case, when the dust collector 100 is connected to the main body 2, the lighting means provided at the dust collector 100 may be placed in the light-on state (active state) but the light part 8 provided at the main body 2 may be placed in the light-off state (non-active state). On the other hand, only the light part 8 of the main body 2 may be placed in the light-on state (active state) when the dust collector 100 is not connected.

In the present embodiment, in the case where the hammer drill 1 is used alone, the LED light of the light part 8 is configured to be automatically tuned on in conjunction with the starting operation for the trigger switch 12. However, the operator may be able to select, as appropriate, whether the light part 8 should be turned on or off.

Further, in the present embodiment, the main body control (such as the control over the motor 3 and the light part 8) is configured to be automatically changed depending on the connection/non-connection of the dust collector 100. However, the operator may be able to select, as appropriate, whether the control for the hammer drill 1 should be changed or not. That is, even when the dust collector 100 is connected, the operator may be able to select that the behavior of the hammer drill 1 when used alone should be maintained. Advantageously, in this case as well, the driving of the dust collector 100 may be started in conjunction with the trigger switch 12 of the hammer drill 1.

Note that, the "turn-off" state of the lighting means in the present invention not only includes a case where the lighting means is completely turned OFF as in the present embodiment, but also includes a case where the lighting means is not completely turned OFF but is slightly lit by receiving a very small amount of power. Further, the "turned-on" state of the lighting means not only includes a case where the lighting means is illuminated as in the above embodiment but also includes a case where the lighting means flashes.

Further, in the above embodiment, the control circuit 71 is configured to stop driving the motor 3 when the acceleration detected by the acceleration sensor 23 exceeds the predetermined acceleration threshold value. Further, the control circuit 71 may be configured to change the acceleration threshold value depending on the presence/absence of the connection of the dust collector 100. With this configuration, the acceleration threshold value can be appropriately set based on whether the hammer drill 1 is used alone or used with the dust collector 100 connected to the main body 2. The main body 2 can be reliably suppressed from being applied with an excessive load.

In the present embodiment, the battery 15 (DC power supply) is used as a power source of the hammer drill 1. However, the hammer drill 1 may receive power from a commercial power source (AC power supply), instead of the battery 15.

Further, the attachment device configured to be detachably connected to the main body of the work tool according to the present invention is not limited to the dust collector as described in the present embodiment for sucking the dust and the like generated from a work piece. For example, as the attachment device, a blower having a blast function to blow off dust or the like generated from a work piece may be connected to the main body of the work tool. Alternatively, a dust collector having a blast function may be connected to the main body of the work tool, as the attachment device.

While the hammer drill 1 according to the present embodiment can impart an impacting force and a rotational force to the end bit 14, the hammer drill 1 may impart only the impacting force or only the rotational force. Further, the end bit 14 may be a driver bit for fastening a screw, or may be a drill bit for drilling or chipping concrete or a stone material.

In the present embodiment, the hammer drill 1 is employed as an example of the work tool. However, the present invention may be applied to a motor-driven work tool other than a hammer drill, for example, to a drilling tool such as an electric hammer, an electric drill, a vibration drill, or a driver drill.

REFERENCE SIGNS LIST

1 . . . hammer drill
2 . . . main body
3 . . . motor
4 . . . drive-transmission part
5 . . . impact mechanism part
6 . . . reciprocating-movement conversion part
7 . . . control substrate part
8 . . . light part
9 . . . power-supply part
12 . . . trigger switch
12A . . . switching mechanism
15 . . . battery
21A . . . battery-connecting terminal part
22A . . . switching circuit
23 . . . acceleration sensor
27 . . . second signal line
91A . . . main-body-side positive terminal
91B . . . main-body-side negative terminal
91C . . . main-body-side signal terminal
100 . . . dust collector
112 . . . collector motor
116A . . . collector-side positive terminal
116B . . . collector-side negative terminal
116C . . . collector-side signal terminal

The invention claimed is:

1. A work tool comprising:

a main body to which an attachment device is connectable, the main body comprising:

a drive source;

a work part configured to be driven by the drive source to perform a work;

a handle;

a manipulation part configured to be operated by a user to drive the drive source;

an assisting part configured to assist the work; and a control circuit configured to perform at least one of:

a control over the drive source; and a control over the assisting part, the control circuit being configured to perform:

(a) detecting whether or not the attachment device is connected to the main body; and (b) changing the at least one of the control over the drive source and the control over the assisting part depending on whether or not the attachment device is connected to the main body;

wherein the control circuit is configured to perform the control over the drive source comprising (d) controlling the drive source, and wherein the (b) changing comprises (e) changing the (d) controlling, depending on whether or not the attachment device is connected to the main body;

wherein, when the (a) detecting detects that the attachment device is not connected to the main body, the (e) changing sets a maximum rotation speed of the drive source to a first rotation speed, and wherein, when the (a) detecting detects that the attachment device is connected to the main body, the (e) changing sets the maximum rotation speed of the drive source to a second rotation speed lower than the first rotation speed.

2. The work tool as claimed in claim 1, wherein the (b) changing comprises (c) changing, depending on whether or not the attachment device is connected to the main body, an operation state of the assisting part during the work between an active state and a non-active state.

3. The work tool as claimed in claim 2, wherein, when the (a) detecting detects that the attachment device is not connected to the main body, the (c) changing sets the operation state of the assisting part during the work to the active state, and wherein, when the (a) detecting detects that the attachment device is connected to the main body, the (c) changing sets the operation state of the assisting part during the work to the non-active state.

4. The work tool as claimed in claim 3, wherein the assisting part is a light configured to irradiate light toward a work spot at which the work part performs the work, wherein the attachment device connected to the main body is positioned between the light and the work spot.

5. The work tool as claimed in claim 1, wherein the drive source is a motor, wherein the manipulation part is configured to receive user's manual operations including a starting operation to start driving the motor and a stop operation to stop driving the motor wherein, when the manipulation part receives the starting operation, the control circuit performs the (a) detecting, and the (d) controlling performs (f) controlling the motor such that a rotational speed of the motor reaches a target rotational speed at a timing when a time period elapses from a timing when the manipulation part receives the starting operation, wherein, when the (a) detecting detects that the attachment device is not connected to the main body, the (e) changing sets the time period to a first time period, and wherein, when the (a) detecting detects that the attachment device is connected to the main body, the (e) changing sets the time period to a second time period longer than the first time period.

6. The work tool as claimed in claim 1, wherein the (d) controlling further performs (g) halting the motor when the manipulation part receives the stop operation, and wherein the control circuit is configured to further perform (h) stopping the attachment device after the (d) controlling performs the (g) halting.

7. The work tool as claimed in claim 1, wherein the main body further comprises an acceleration sensor configured to detect an acceleration of the main body, wherein the control circuit is configured to perform the control over the drive source comprising (i) controlling the drive source, and wherein, when the acceleration detected by the acceleration sensor exceeds an acceleration threshold value, the (i) controlling stops driving the drive source.

8. The work tool as claimed in claim 7, wherein the (b) changing further comprises (j) changing the acceleration threshold value depending on whether or not the attachment device is connected to the main body.

9. The work tool as claimed in claim 1, wherein the attachment device comprises:

an attachment-device motor configured to be driven upon receipt of power supply from the main body in a state where the attachment device is connected to the main body; and a switch switchable between a first state allowing the power supply to the attachment- device motor and a second state interrupting the power supply, wherein the main body includes a signal line connected to the switch in the state where the attachment device is connected to the main body, and wherein the (a) detecting is performed by outputting a control signal to the signal line, the control signal being for bringing the switch into the first state.

10. The work tool as claimed in claim 9, wherein the attachment device further comprises an attachment-device-side resistor, the attachment-device-side resistor being connected to the signal line in the state where the attachment device is connected to the main body, wherein the signal line includes a main-body-side resistor having one end and another end, the one end being connected to the control circuit the another end being connected to the attachment-device-side resistor in the state where the attachment device is connected to the main body, wherein the (a) detecting is performed using a divided voltage, the divided voltage being obtained by dividing a voltage of the control signal by the attachment-device-side resistor and the main-body-side resistor.

11. The work tool as claimed in claim 1, wherein the attachment device is a dust collector configured to generate negative pressure at a work spot at which the work is performed by the work part.

12. The work tool as claimed in claim 1, wherein the work tool is a drilling tool.

13. A work tool comprising:

a main body to which an attachment device is connectable, the main body comprising:

a drive source;

a work part configured to be driven by the drive source to perform a work;

a handle;

a switch part configured to be operated by a user to drive the drive source; and a light configured to irradiate light toward a work spot at which the work part performs the work, a part of the attachment device being positioned between the light and the work spot in a state where the attachment device is connected to the main body; and a control circuit configured to perform a control over the light, the control circuit being configured to perform:

(a) detecting whether or not the attachment device is connected to the main body; and (b) changing the control over the light depending on whether or not the attachment device is connected to the main body, wherein, when the (a) detecting detects that the attachment device is not connected to the main body, the (b) changing sets an operation state of the light during the work to an active state, and wherein, when the (a) detecting detects that the attachment device is connected to the main body, the (b) changing sets the operation state of the light during the work to a non-active state.

14. The work tool as claimed in claim 13, wherein the attachment device comprises an attachment-device-side light configured to irradiate light toward the work spot, and wherein, when the (a) detecting detects that the attachment device is connected to the main body, the (b) changing sets an operation state of the attachment-device-side light during the work to an active state.

15. The work tool as claimed in claim 13, wherein the (b) changing is performed in response to a user's operation to the switch part.

16. The work tool as claimed in claim 13, wherein the main body is further configured to detachably receive a battery configured to supply power to the drive source, and wherein the light is configured to receive power from the battery attached to the main body.

17. The work tool as claimed in claim 13, wherein the main body further comprises a main-body-side terminal connectable to the attachment device for supplying power to the attachment device in a state where the attachment device is connected to the main body, wherein the (a) detecting is performed using the main-body-side terminal.

18. The work tool as claimed in claim 17, wherein the main-body-side terminal is provided on a front portion of the main body at a position below the light.

19. A work tool comprising:

a main body to which an attachment device is connectable, the main body comprising:

a drive source;

a work part configured to be driven by the drive source to perform a work;

a handle; and a switch part configured to be operated by a user to drive the drive source; and a control circuit configured to perform a control over the drive source, the control circuit being configured to perform:

(a) detecting whether or not the attachment device is connected to the main body; and (b) changing the control over the drive source depending on whether or not the attachment device is connected to the main body;

wherein the drive source is a motor, wherein the switch part is configured to receive user's manual operations including a starting operation to start driving the motor and a stop operation to stop driving the motor, wherein, when the switch part receives the starting operation, the control circuit performs the (a) detecting, and the (b) changing performs (c) controlling the motor such that a rotational speed of the motor reaches a target rotational speed at a timing when a time period elapses from a timing when the switch part receives the starting operation, wherein, when the (a) detecting detects that the attachment device is not connected to the main body, the (c) controlling sets the time period to a first time period, and wherein, when the (a) detecting detects that the attachment device is connected to the main body, the (c) controlling sets the time period to a second time period longer than the first time period.

* * * * *